US011279543B2

(12) United States Patent
Capitani

(10) Patent No.: US 11,279,543 B2
(45) Date of Patent: Mar. 22, 2022

(54) PACKAGE, APPARATUS AND PROCESS OF MANUFACTURING SUCH A PACKAGE

(71) Applicant: Cryovac, LLC, Charlotte, NC (US)

(72) Inventor: Stefano Capitani, Como (IT)

(73) Assignee: Cryovac, LLC, Charlotte, NC (US)

( * ) Notice: Subject to any disclaimer, the term of this patent is extended or adjusted under 35 U.S.C. 154(b) by 180 days.

(21) Appl. No.: 16/615,173

(22) PCT Filed: May 18, 2018

(86) PCT No.: PCT/IB2018/053509
§ 371 (c)(1),
(2) Date: Nov. 20, 2019

(87) PCT Pub. No.: WO2018/215896
PCT Pub. Date: Nov. 29, 2018

(65) Prior Publication Data

US 2020/0231355 A1 Jul. 23, 2020

(30) Foreign Application Priority Data

May 22, 2017 (IT) ..... 102017000055326

(51) Int. Cl.

| | |
|---|---|
| ***B65D 77/20*** | (2006.01) |
| ***B65B 9/04*** | (2006.01) |
| ***B65B 31/02*** | (2006.01) |
| ***B65B 61/00*** | (2006.01) |
| ***B65B 61/08*** | (2006.01) |
| ***B65B 61/18*** | (2006.01) |
| ***B65D 81/20*** | (2006.01) |

(52) U.S. Cl.
CPC ..... *B65D 77/2052* (2013.01); *B65B 9/04* (2013.01); *B65B 31/021* (2013.01);
(Continued)

(58) Field of Classification Search
CPC ..... B65D 77/2052; B65D 77/2056; B65D 81/2015; B65D 81/2076; B65D 2577/205;
(Continued)

(56) References Cited

U.S. PATENT DOCUMENTS 2,762,720 A 9/1956 Rudolph et al.
4,381,848 A * 5/1983 Kahn ..... B65D 77/2044 206/525

(Continued)

FOREIGN PATENT DOCUMENTS

EP 529797 A1 3/1993
EP 2292552 A1 3/2011

(Continued)

*Primary Examiner* — Kareen K Thomas
(74) *Attorney, Agent, or Firm* — Jon M. Isaacson

(57) ABSTRACT

A package includes a support and a closing film. The support has a supporting portion that receives a product, a perimetral edge surrounding the supporting portion, a gripping portion extending away from the opposite side of the supporting portion, a removable portion extending from the supporting portion. The closing film engages a portion of the perimetral edge and, with the support, defines a housing compartment for the product. The closing film comprises a first film portion engaged with the removable portion and a second film portion engaged with the gripping portion. When the package is opened, the removable portion at least partly separates from the support together with the first film portion and the second film portion remains engaged with the gripping portion of the support.

19 Claims, 14 Drawing Sheets

(52) U.S. Cl.
CPC ..... *B65B 61/005* (2013.01); *B65B 61/08* (2013.01); *B65B 61/18* (2013.01); *B65D 77/2056* (2013.01); *B65D 81/2015* (2013.01); *B65D 81/2076* (2013.01); *B65D 2577/205* (2013.01); *B65D 2577/2083* (2013.01)

(58) Field of Classification Search
CPC ..... B65D 2577/2083; B65D 77/2032; B65B 9/04; B65B 31/021; B65B 61/005; B65B 61/08; B65B 61/18
See application file for complete search history.

(56) References Cited

U.S. PATENT DOCUMENTS

| | | | | |
|---|---|---|---|---|
| 4,456,164 | A * | 6/1984 | Foster | B65D 77/2032 229/125.35 |
| 4,469,258 | A * | 9/1984 | Wright | B65B 7/168 229/123.1 |
| 4,794,978 | A | 1/1989 | Lauener | |
| 5,916,613 | A | 6/1999 | Walker | |
| 6,056,141 | A * | 5/2000 | Navarini | B32B 27/08 220/269 |
| 7,803,416 | B2 | 9/2010 | Roveda et al. | |
| 8,256,636 | B2 * | 9/2012 | Huffer | B65D 77/2036 220/266 |
| 9,944,446 | B2 * | 4/2018 | Huffer | B29C 65/76 |
| 2014/0231433 | A1 * | 8/2014 | Liu | B65D 21/0219 220/276 |

FOREIGN PATENT DOCUMENTS

| | | | |
|---|---|---|---|
| FR | 3002209 | A1 | 8/2014 |
| KR | 20160013858 | A1 | 2/2016 |
| WO | 9954398 | A1 | 10/1999 |
| WO | 2007093495 | A1 | 8/2007 |
| WO | 2008029332 | A2 | 3/2008 |
| WO | 2009011571 | A1 | 1/2009 |

* cited by examiner

FIG.1
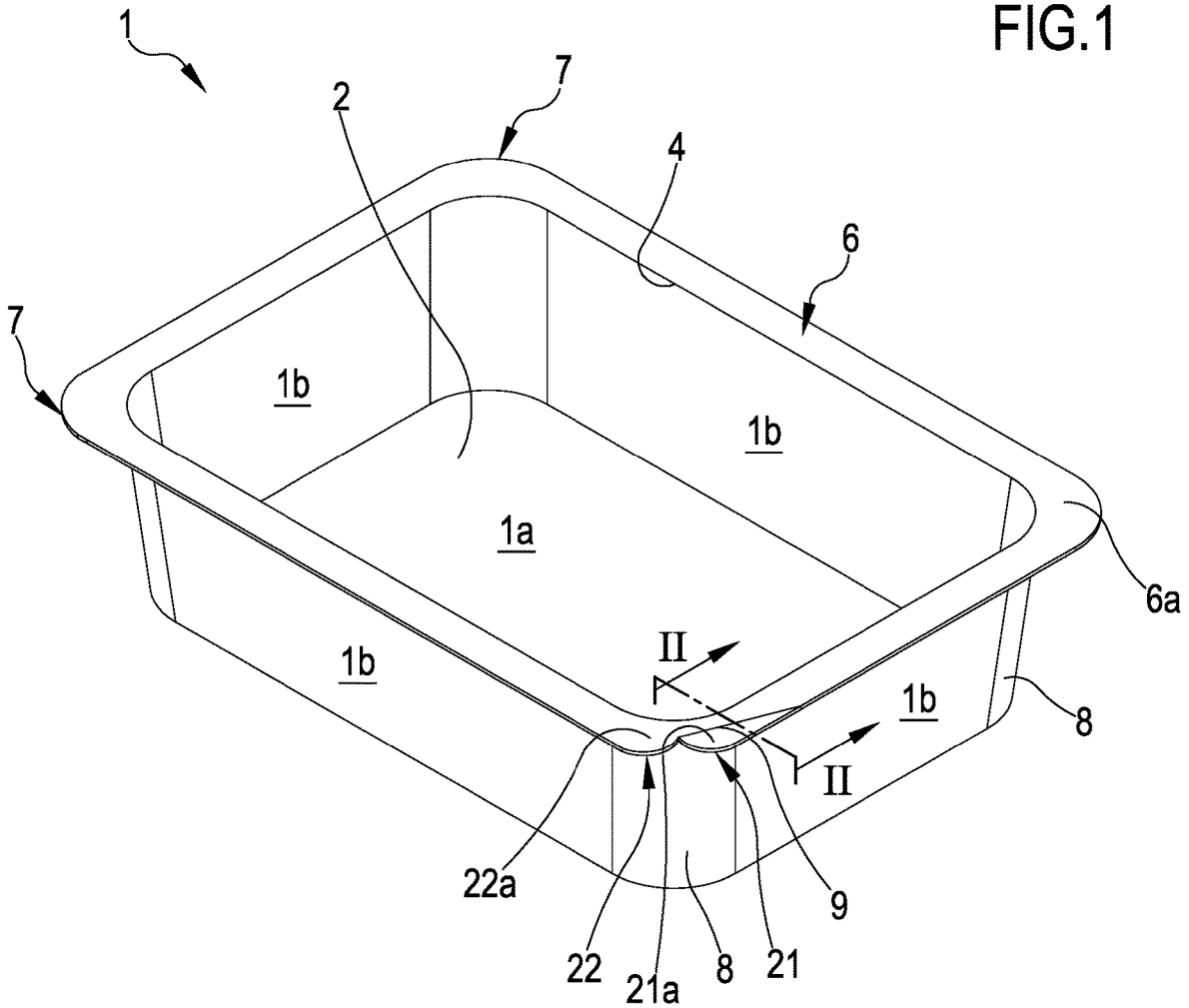
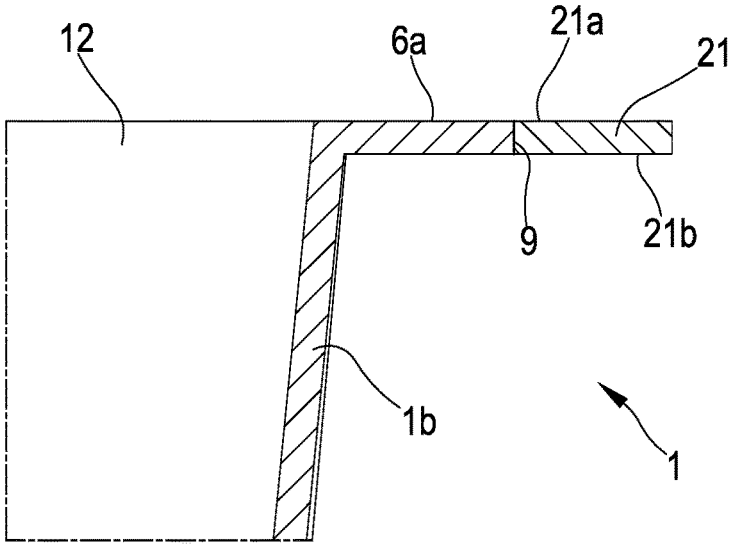
FIG.2

FIG.3
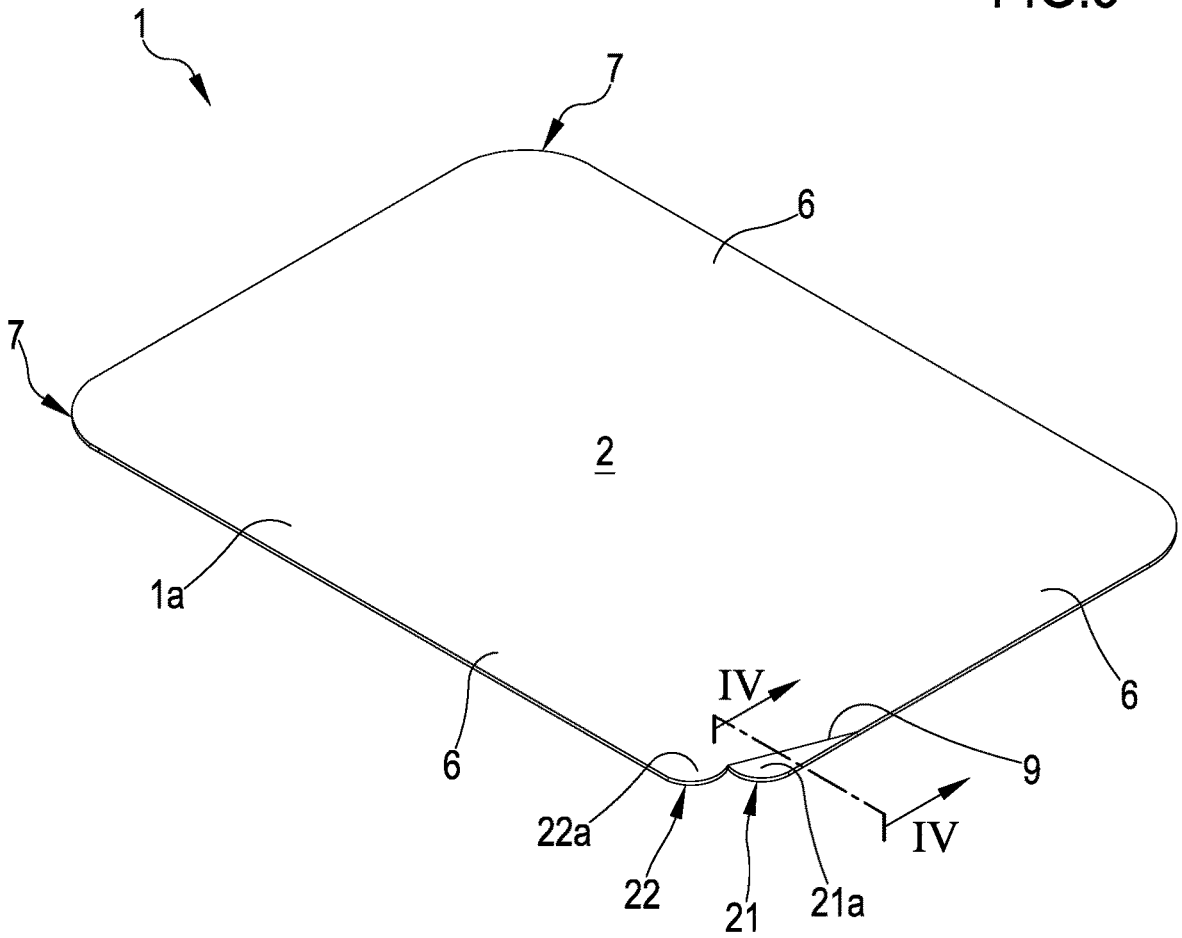
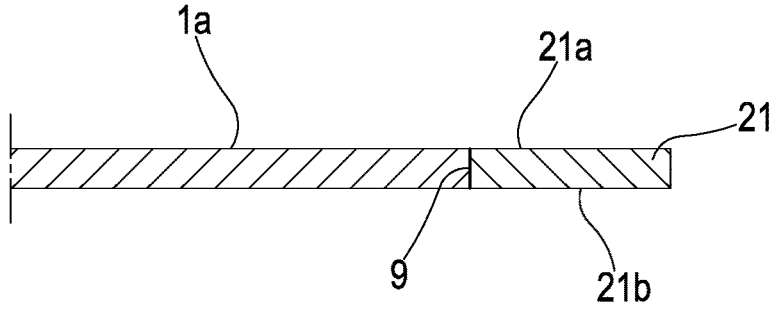
FIG.4

FIG.5
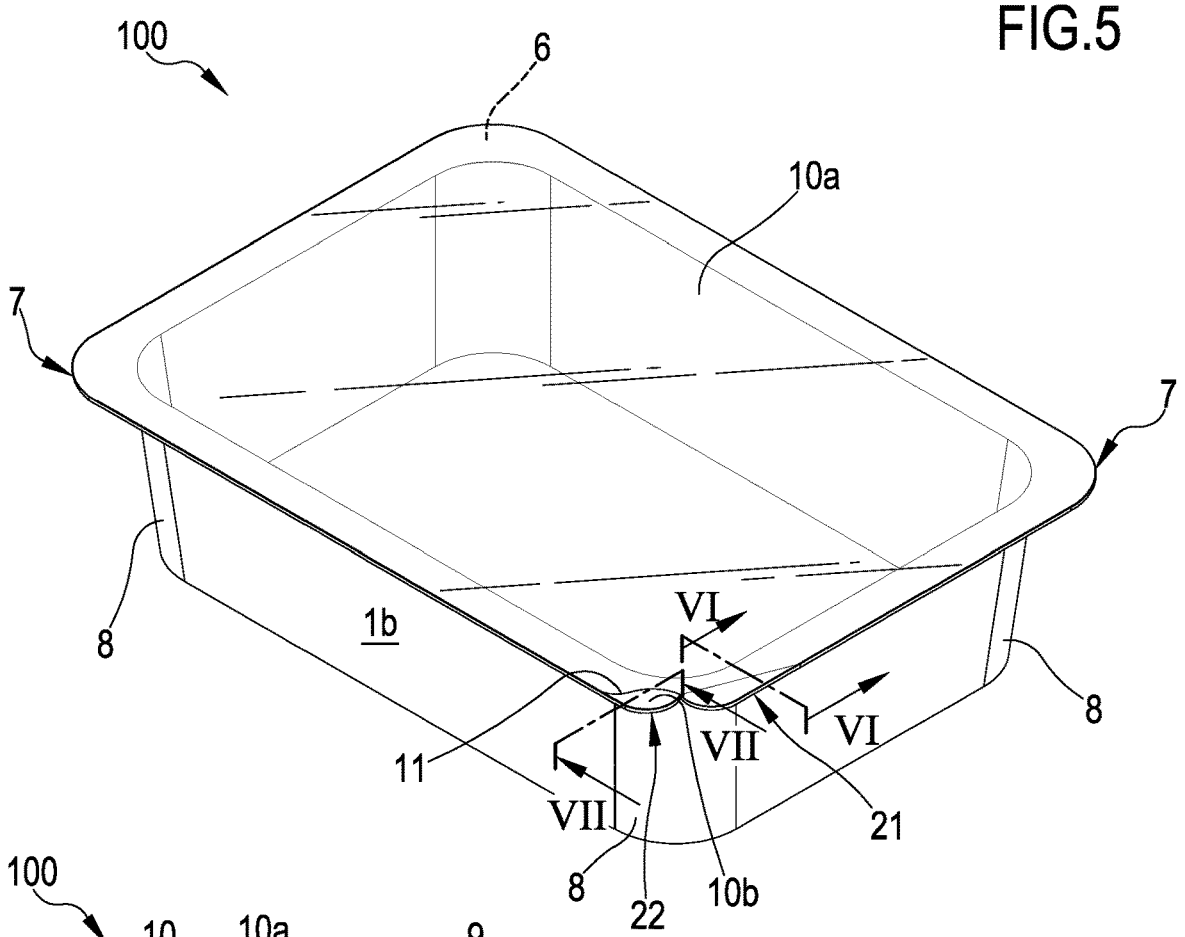
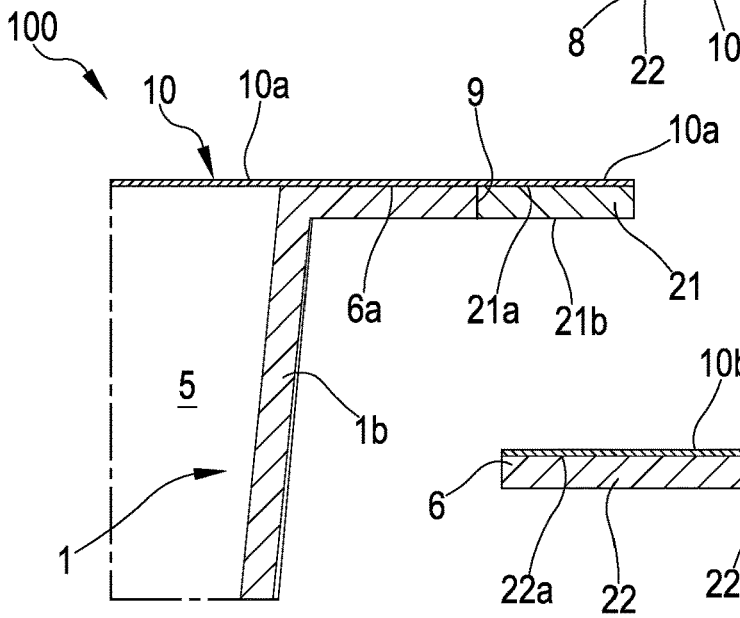
FIG.6
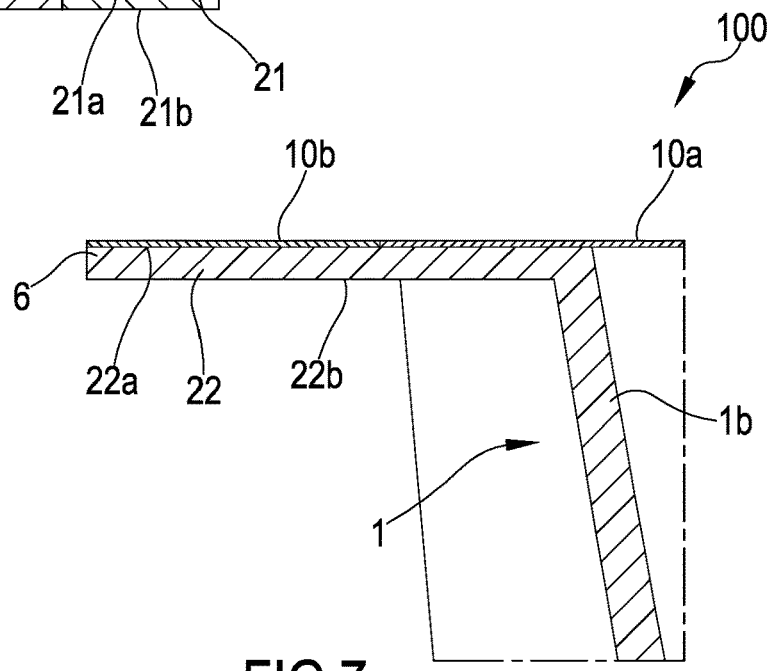
FIG.7

FIG.11
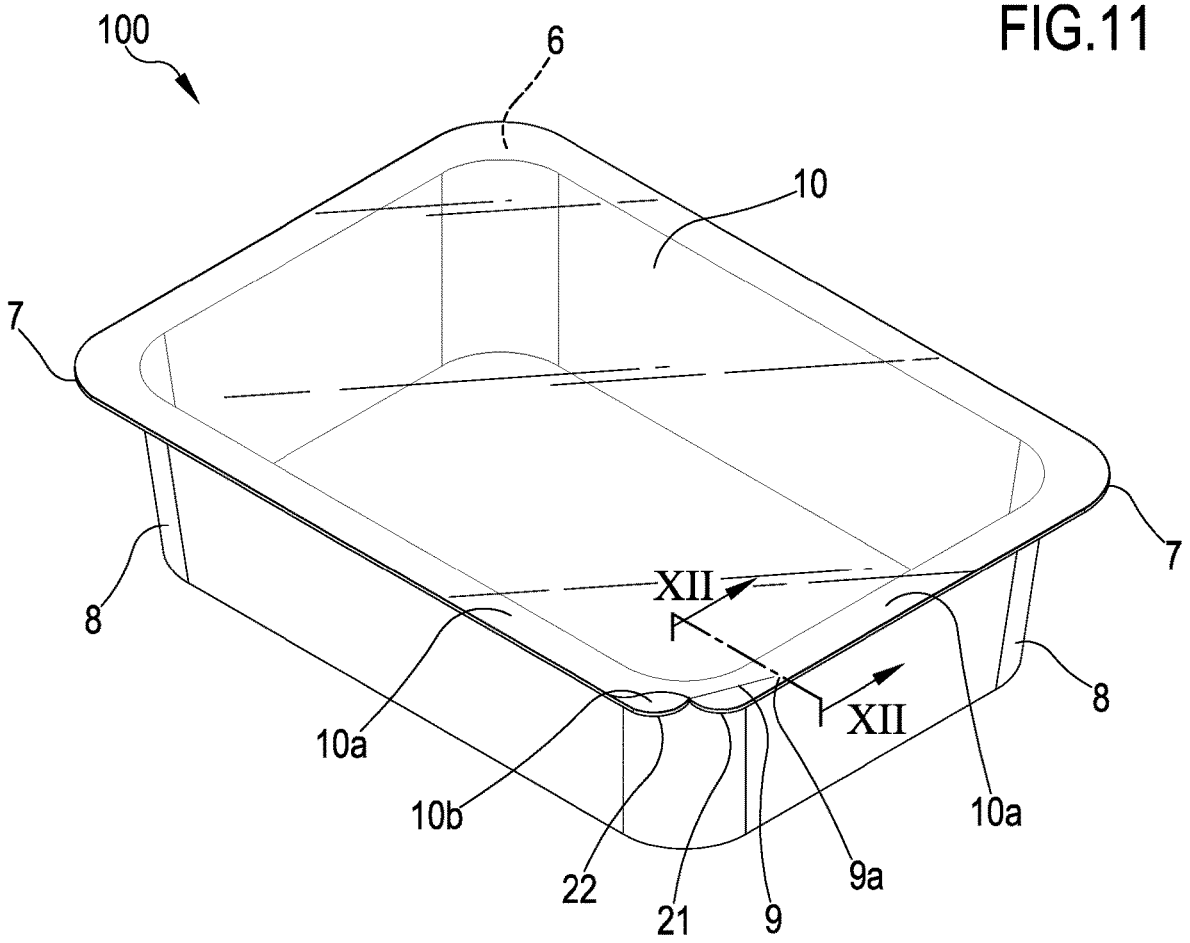
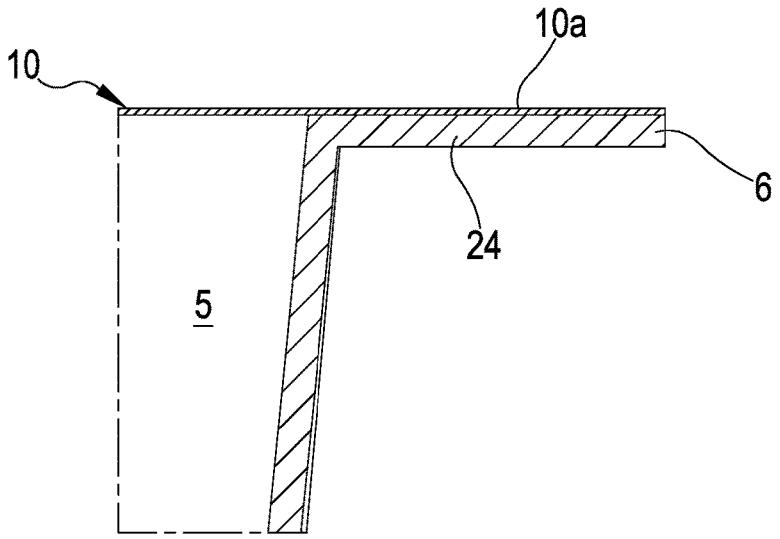
FIG.12

PACKAGE, APPARATUS AND PROCESS OF MANUFACTURING SUCH A PACKAGE

FIELD OF THE INVENTION

The present invention relates to a package for containing products, for example of a food type. The invention also relates to a process and a relative apparatus for manufacturing said package, in particular using a support designed to house at least one product, and at least one plastic film, designed to mate with the support in order to seal the product in a package. The invention can find particular application in vacuum packaging or in a controlled atmosphere of products of various kinds.

PRIOR ART

Apparatus and related methods for packaging products are known in the field of packaging. Among the packaging processes, processes that make packages with plastic films for sealing foods such as meat and fish to be frozen, cheese, treated meat, ready meals and similar foods are known.

In the food packaging field, packages are known, closed by means of plastic films having a facilitated opening system which facilitates the opening of the package by the user, thus ensuring a simple and rapid extraction of the product from the package.

The international patent application no. WO2008029332, for example, describes a package with facilitated opening consisting of a first and a second plastic film coupled together at an outer perimetral edge so as to define a housing compartment for one or more products (the products are interposed between the first and the second film). The package has a facilitated opening system consisting of two side-by-side flaps, not overlapping each other, respectively of the first and second plastic films which emerge from the perimetral closing edge of the package. The flaps are configured for defining respective gripping portions adapted to allow the opening of the package.

Although the opening system of the aforementioned international application represents a facilitated access point for the package, the Applicant has noted that the package is not however without drawbacks. In fact, due to the flexible structure of the package and in particular the structure of the facilitated opening system, the same package is difficult to grip and above all complex to handle during the opening steps thereof.

The French application no. FR3002209, on the other hand, describes a package with a facilitated opening consisting of a support and a plastic film welded at a perimetral edge of the support. The support comprises a gripping portion emerging from the perimetral edge; the film comprises a closing portion welded to said perimetral edge and a respective gripping portion emerging from the latter: the gripping portions of the support and the closing film, respectively, define an opening system of the package. A first part of the gripping portion of the film is superimposed (not constrained) to the gripping portion of the support and is configured for being raised relative to the latter while a second part of the gripping portion of the film is flanked by the gripping portion of the support and emerges from the perimetral edge of the latter. The second part has a stiffening tab fixed below the sealing film and deriving from the support. The second part of the gripping portion is the part of film which can be grasped by the user for opening the package; the gripping portion of the support, on the other hand, is the part which can be grasped by the user for holding the support during the step of removing the film from the package.

While the solution described in the aforementioned French application allows defining a package with a facilitated opening, the Applicant has found that the complex structure of the opening system requires the user to first detect the correct gripping portion to be raised (film gripping portion) in such a way that the gripping portion of the support can be shown, a portion otherwise covered by the plastic film obstructing the subsequent step of removal of the film itself.

OBJECT OF THE INVENTION

The object of the present invention is to substantially solve the drawbacks and/or limitations of the above prior art.

A first object of the invention is to provide a package, for example for food products, having an effective facilitated opening system to allow the user a simple and quick opening of the package; in particular, it is an object of the present invention to provide a package that provides the user with a rapid tactile and visual perception of the facilitated opening system.

A further object of the present invention is to provide a package having a simple and cost-effective structure which at the same time can ensure a convenient and stable handling of the package at least during the opening of the latter. It is also an additional object of the present invention to ensure the opening of the package by means of a single movement and therefore without requiring the user to change the grip of the package during the opening steps.

A further object is to provide a package that can be manufactured by means of a simple and fast in-line production, which does not require expensive modifications to the manufacturing plants of standard packages, i.e. without a facilitated opening system.

These and yet other objects, which will become more apparent from the following description, are substantially achieved by a package, an apparatus and a related process for manufacturing said package according to what is expressed in one or more of the accompanying claims and/or the following aspects, taken alone or in any combination with each other or in combination with any one of the appended claims and/or in combination with any of the other aspects or features described below.

SUMMARY

Aspects of the invention are described hereinafter.

In a 1st aspect, a package (100) is provided for containing at least one product (P), for example a food-type product, said package (100) comprising:

- at least one support (1) exhibiting:
  - at least one supporting portion (2) configured for receiving one or more products (P),
  - at least one perimetral edge (6) entirely surrounding the supporting portion (2),
  - a gripping portion (22) of the perimetral edge (6), extending oppositely to the supporting portion (2);
  - at least one removable portion (21) of the perimetral edge (6), also extending oppositely to the supporting portion (2);
- a closing film (10) engaged with at least a portion of the perimetral edge (6) and configured for defining—in cooperation with the support (1) —a housing compartment (5) for the product (P), said closing film (10)

comprising a first film portion (10*a*) engaged with the removable portion (21), said removable portion (21) being configured for being separated at least partly from the support (1) together with the first film portion (10*a*) during a step of opening the package, the closing film (10) comprising a second film portion (10*b*) engaged with the gripping portion (22) of the support (1), said second film portion (10*b*) being configured for remaining engaged with the gripping portion (22) of the support during the step of opening the package (100).

In a 2nd aspect according to the preceding aspect, the second film portion (10*b*), optionally prior to the step of opening the package, is:

separated from the first portion (10*a*) of the closing film (10), or joined to said first portion (10*a*) by a weakening portion of the same closing film, said weakening portion being configured for ensuring the separation of the first and second portion of the closing film during the step of opening of the package.

In a 3rd aspect according to any one of the preceding aspects, the first film portion (10*a*) is engaged to the perimetral edge (6) with the exception of the gripping portion (22).

In a 4th aspect according to any one of the preceding aspects, the second film portion (10*b*) is only engaged with the gripping portion (22) of the perimetral edge (6).

In a 5th aspect according to any one of the preceding aspects, the removable portion (21), prior to the step of opening the package, is:

separated from the perimetral edge (6) integrally joined to the support (1); or integrally joined to the perimetral edge (6) of the support (1) by a weakening portion (24) of the support, said weakening portion being configured for ensuring the separation of the removable portion (21) itself from the support (1) during the step of opening the package (100).

In a 6th aspect according to any one of the preceding aspects, the gripping portion (22) is integrally joined to the perimetral edge (6).

In a 7th aspect according to any one of the preceding aspects, the gripping portion (22) is flanked by the removable portion (21).

In an 8th aspect according to any one of the preceding aspects, the perimetral edge (6) comprises an upper surface (6*a*) for receiving the first film portion (10*a*), which extends along a lying plane, wherein the second film portion (10*b*) extends along a plane parallel to the lying plane of said upper surface (6*a*).

In a 9th aspect according to any one of the preceding aspects, the second film portion (10*b*) is configured for remaining coplanar with the upper surface (6*a*) of the perimetral edge during the step of opening the package (100).

In a 10th aspect according to any one of the preceding aspects, the removable portion (21) has a mechanical stiffness greater than a mechanical stiffness of the closing film (10).

In an 11th aspect according to any one of the preceding aspects, the removable portion (21) has a mechanical stiffness substantially equal to a mechanical stiffness of the perimetral edge (6) of the support (1).

In a 12th aspect according to any one of the preceding aspects, the support (1) comprises:

a base (1*a*), a lateral wall (1*b*) transversally emerging from the base (1*a*) for defining a housing seat adapted to receive the product (P), wherein the perimetral edge (6) along with the gripping portion (22) are integrally joined to the lateral wall (1*b*) oppositely to the base (1*a*), wherein the perimetral edge (6) defines an upper free edge of the support (1) delimiting an opening (12) of the latter.

In a 13th aspect according to any one of the preceding aspects, the support (1) comprises at least one angular portion (7), wherein said removable portion (21) is disposed at the angular portion of the support, optionally said removable portion (21) defines at least part of said angular portion (7).

In a 14th aspect according to any one of the preceding aspects, the support (1) comprises at least one angular portion (7), wherein said gripping portion (22) is disposed at the angular portion of the support, optionally said gripping portion (22) defines at least part of said angular portion (7).

In a 15th aspect according to the preceding aspect in which the gripping portion and the removable portion are disposed at a same angular portion (7) of the support (1), optionally the gripping portion and the removable portion define (optionally delimit) a same angular portion of the support.

In a 16th aspect according to any one of the preceding aspects, the support (1) comprises a plurality of angular portions (7), the removable portion (21) and the gripping portion (22) defining at least one angular portion (7) of said support (1).

In a 17th aspect according to any one of the preceding aspects, the perimetral edge (6) has a flat closing surface for receiving the closing film (10) which is—before the step of opening the package—substantially coplanar to a respective surface for receiving the closing film of the removable portion (21).

In an 18th aspect according to any one of the preceding aspects, the support (1) has a rectangular or square shape.

In a 19th aspect according to any one of the preceding aspects, the support (1) is made of at least one material selected from the following group: plastic, paper material, aluminum.

In a 20th aspect according to any one of the preceding aspects, the closing film (10) is engaged to the perimetral edge (6), to the gripping portion (22) and to the removable portion (21) by heat-sealing.

In a 21st aspect according to any one of the preceding aspects, the package comprises at least one product, optionally of a food-type, disposed in the housing compartment (5) of the package (100), wherein the closing film is fluid-tightly engaged with the perimetral edge (6) of the support (1) so that the housing compartment (5) inside which said product (P) is housed, is fluid-tight.

In a 22nd aspect according to any one of the preceding aspects, the closing film is applied to the support so as to form a vacuum package in which a pressure substantially lower than the atmospheric pressure is present inside the housing compartment (5) (T=20° C., above sea level), the closing film forming a plastic skin at least partly in contact with the product (P) and the support (1).

In a 23rd aspect according to any one of the aspects from 12th to 22nd, the closing film is applied to the support so as to form a hermetically sealed package in which inside the housing compartment (5) a modified atmosphere is present (i.e. having a different composition with respect to the normal atmospheric composition), the closing film being engaged with the perimetral edge and spaced from the base of the support (1).

In a 24th aspect, a process is provided for manufacturing a package (100) for containing at least one product (P) according to any one of the preceding aspects, said process comprising at least the following steps:

- moving a sheet material (200) along a predetermined advancement path, said sheet material (200) comprising:
  - at least one supporting portion (2) configured for receiving one or more products (P),
  - at least one closing portion (60) entirely surrounding the supporting portion (2),
- performing at least one incision on the closing portion (60) of the sheet material (200) adapted to define said removable portion (21),
- positioning at least one product (P) on the supporting portion (2) of said sheet material (200),
- following positioning the product (P) on the sheet material (200), constraining a closing film (201) to the closing portion (60) of the sheet material (200) so that the product (P) is positioned inside a housing compartment (5) defined by the closing film (201) constrained to said sheet material (200),
- performing at least one incision of the closing film (201) engaged with the closing portion (60) of the sheet material (200) for defining the first and second film portions (10*a*, 10*b*) respectively engaged with the removable portion (21) and the gripping portion (22) of the support (1).

In a 25th aspect according to the preceding aspect, the process further comprises the following step:

- making at least one through cut of the sheet (200) and closing film (201), such through cut—cooperatively with the incision of the closing portion (60) of the sheet material (200) and the incision of the closing film (201)—defines said package (100).

In a 26th aspect according to the preceding aspect, the through cut intersects, in at least one point, one selected between the incision of the closing portion (60) of the sheet material (200) and the incision of the closing film (201).

In a 27th aspect according to the 25th or 26th aspect, the through cut defines the perimetral edge (6) of the package surrounding the supporting portion (2).

In a 28th aspect according to any one of the aspects 24th to 27th, the incision step of the closing film (201) is subsequent to the step of constraining the closing film (201) to the closing portion (60) of the sheet material (200).

In a 29th aspect according to any one of the aspects 24th to 28th, the positioning of the product (P) on the supporting portion (2) is prior to the step of constraining the closing film (201) to the closing portion (60) of the sheet material (200).

In a 30th aspect according to any one of the aspects 25th to 29th, the step of through cut of the sheet (200) and of the closing film (201) is subsequent to the step of constraining said closing film (201) to the closing portion (60) of the sheet material (200).

In a 31st aspect according to any one of the aspects 24th to 30th, the incision of the closing portion (60) is through the sheet material (200).

In a 32nd aspect according to any one of the aspects from 24th to 31st, the incision of the closing film (201) defines a through cut of the closing film (201).

In a 33rd aspect according to any one of the aspects 24th to 32nd, the incision of the closing film (201) is performed by means of a high intensity concentrated laser light beam.

In a 34th aspect according to any one of the aspects 24th to 33rd, the incision step of the closing film only incises said closing film (201).

In a 35th aspect according to any one of the aspects 25th to 34th, the through cut of the sheet (200) and closing film (201) defines, in particular in a single step, the removable portion (21) and gripping portion (22) of the package (100).

In a 36th aspect according to any one of the aspects 24th to 35th, the constraining of the closing film (201) on the closing portion (60) of the sheet material (200) is performed by heat-seal, optionally for defining a fluid-tight housing compartment (5) for the product (P).

In a 37th aspect according to any one of the aspects 24th to 36th, the process comprises a step—after that of positioning the product (P) on the supporting portion (2) and before that of constraining the closing film—of removing at least part of the air from the housing compartment (5) in order to define inside the latter a pressure less than the atmospheric pressure.

In a 38th aspect according to any one of the aspects 24th to 36th, the process comprises a step—after that of positioning the product (P) on the supporting portion (2) and before that of constraining the closing film—of removing at least part of the air from the housing compartment (5) and of inserting inside the latter a predetermined type of gas for defining a modified-atmosphere package.

In a 39th aspect according to any one of the aspects 24th to 38th, the process comprises a step of forming a plurality of cavities on the sheet material (200) so that the latter defines a plurality of trays aligned along the advancement path (A).

In a 40th aspect according to the preceding aspect, the step of forming the cavity takes place prior to the positioning of the product (P) on the sheet material (200).

In a 41st aspect according to any the 39th or 40th, said forming step enables to define at least a plurality of trays aligned along a direction transversal, optionally orthogonal, to the advancement path (A) of said sheet material (200).

In a 42nd aspect according to any one of the aspects 39th to 41st, the sheet material (200) is made of plastic material, wherein the step of forming the plurality of cavities takes place by thermoforming the sheet material (200).

In a 43rd aspect according to any one of the aspects 24th to 42nd, the sheet material (200) is a tape.

In a 44th aspect according to any one of the aspects 24th to 43rd, the movement of the sheet material (200) involves unwinding the reel of material along the advancement path (A).

In a 45th aspect according to any one of the aspects 24th to 44th, the closing film is a tape.

In a 46th aspect according to any one of the aspects 24th to 45th, the process involves unwinding the closing film (201) from the reel, positioning it above the sheet material (200) for closing the package (100).

In a 47th aspect, an apparatus (300) is provided for making a package according to any one of the aspects 1st to 23rd, the apparatus (300) being configured for performing the process according to any one of the aspects 24th to 46th, said apparatus (300) comprising:

- a conveyor (302) configured for moving the sheet material (200) along a predetermined advancement path (A),
- a second supplying assembly (303) configured for delivering the closing film (201), a packaging station (307) configured for receiving the sheet material (200) on which one or more products (P) and at least one portion (201) of said closing film (201) are housed, said packaging station (307) being configured for fluid-tightly engaging the closing film (201) to the sheet material (200), at least one first incision station (305) placed upstream the packaging station (307) with respect to the advancement path (A) of the sheet material (200) and which is configured for incising the latter, at least one second incision station (309) placed downstream the packaging station (307) with respect to the advancement path (A) of the sheet material and which is configured for incising the closing film (201) —or a portion of the closing film (201*a*) —engaged on the sheet material (200).

In a 48th aspect according to the preceding aspect, the apparatus comprises at least one cutting station (310) placed downstream the second incision station (309) configured for defining a through cut of the sheet material (200) and closing film (201) for forming said packages (100).

In a 49th aspect according to the 47th or 48th aspect, the apparatus comprises at least one control unit (311) connected to the conveyor (302), to the second supplying assembly (303), to the packaging station (307), to the first incision station (305) and to the second incision station (309), said control unit (4) being configured for:

commanding the conveyor (302) to allow movement of the sheet material (200) along the operating path, commanding the second supplying assembly (303) for delivering the closing film (201), commanding the first cutting station (305) for defining one or more incisions on the sheet material (200), commanding the packaging station (307) so as to allow the engagement of the closing film (201) —or portion of closing film (201*a*) —on the sheet material (200), commanding the second incision station (309) to define one or more incisions on the closing film, synchronizing the operation of the first and second incision stations (305, 309) according to at least one of the following parameters:

a predetermined movement speed of the sheet material (200) imparted by the conveyor (302) along the advancement path (A), a predetermined supply rate of the closing film (201).

In a 50th aspect according to the preceding aspect, the control unit (311) is connected to the cutting station (310) and is configured for commanding the actuation of the latter for making the packages (100), optionally, the control unit is configured for synchronizing the operation of the cutting station with at least one of the stations of the apparatus placed upstream of the latter of said cutting station, with respect to the advancement path (A).

In an 51st aspect according to any one of aspects 47th to 50th, the packaging station (307) comprises:

an upper tool (307*a*) having heater of the closing film (201), or closing film portion (201*a*), a lower tool (307*b*) configured for receiving the sheet material (200), optionally one or more supports (1), wherein the upper and lower tool (307*a*, 307*b*) are movable relative to one another between at least one spaced condition, at which the lower tool and the upper tool (307*a*, 307*b*) allow the input in the packaging station (307) of the closing film (201) or closing film portion (201*a*) —and of the sheet material (200), and at least one approached closed condition, at which the lower and upper tool (307*a*, 307*b*) define a fluid-tight chamber.

In a 52nd aspect according to the preceding aspect, the control unit (311) is configured for synchronizing the operation of the first and second incision station (305, 309) according to at least one of the following parameters:

the relative position between the lower tool and the upper tool (307*a*, 307*b*) of the packaging station (307), an active condition of the upper tool (307*a*) in which the same heats the film portion (201*a*) in engagement on the same tool.

In an 53rd aspect according to any one of aspects 47th to 52nd, the apparatus comprises at least one of:

a suction system configured for removing air from inside the packaging station (307) to define within it a pressure lower than the atmospheric pressure, a blowing system configured for introducing gas inside the packaging station (307) to define within it a modified atmosphere environment.

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIG. 1 is a sectional view of an embodiment of a support of a package according to the present invention;

FIG. 2 is a sectional view, according to line II-II, of the system in FIG. 1;

FIG. 3 is a sectional view of a further embodiment of a support of a package according to the present invention;

FIG. 4 is a sectional view, according to line IV-IV, of the support in FIG. 3;

FIG. 5 is a perspective view of a package according to the present invention;

FIGS. 6 and 7 are sectional views, respectively according to lines VI-VI and VII-VII, of the package in FIG. 5;

FIGS. 11-13 are further schematic views of a package according to the present invention according to a further embodiment;

CONVENTIONS

Figure 8:
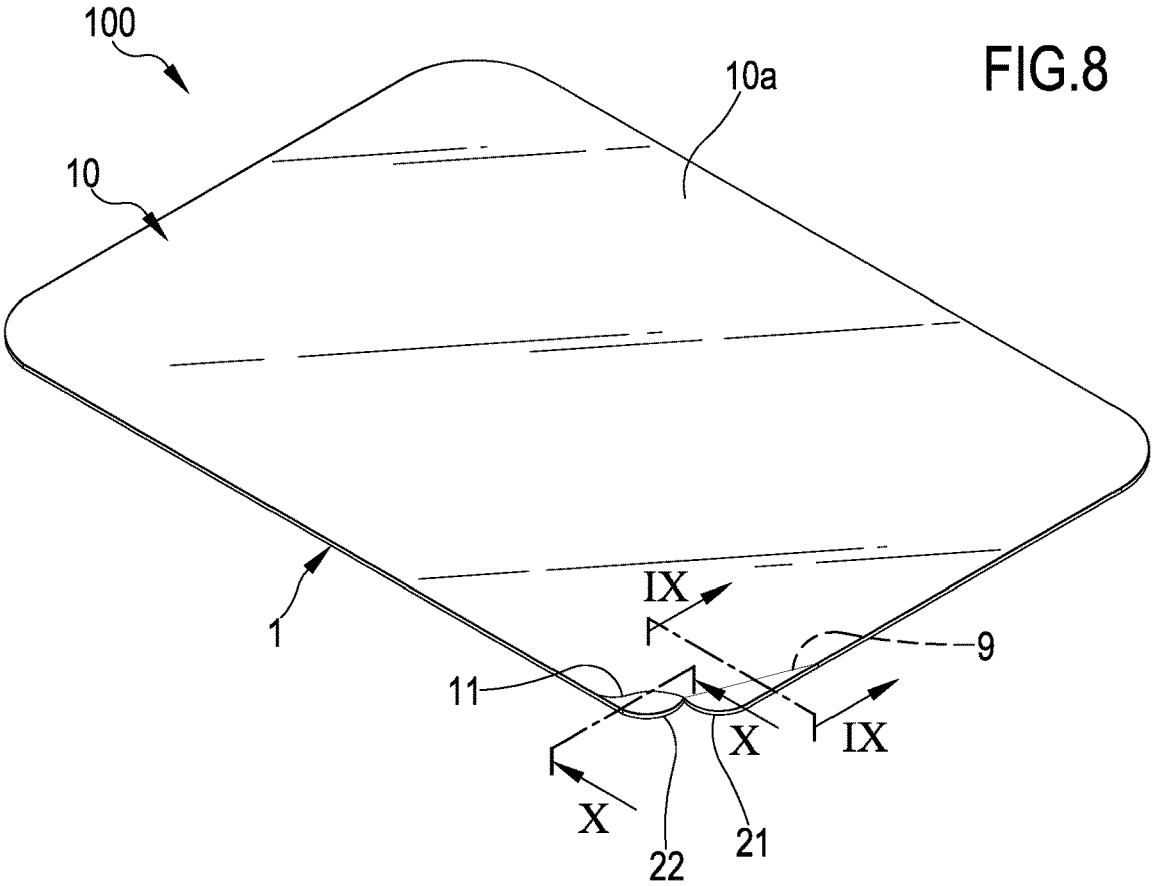
FIG. 8 is a sectional view of a further embodiment of a package according to the present invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of a package—or of a support for making said package—along a predetermined path starting from a starting or forming station of a support for said package, through a packaging station and then up to a package unloading station.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described and claimed herein includes at least one control unit designed to control the operations performed by the apparatus. The control unit can clearly be only one or be formed by a plurality of different control units according to the design choices and the operational needs.

The term control unit means an electronic component which can include at least one of: a digital processor (CPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

Actuator

The term actuator means any device capable of causing movement on a body, for example on a command of the control unit (reception by the actuator of a command sent by the control unit). The actuator can be of an electric, pneumatic, mechanical (for example with a spring) type, or of another type.

Support

The term support means both a flat support and a tray comprising at least one base and at least one lateral wall emerging from the outer perimeter of the base and optionally a terminal flange emerging radially outwardly from an upper perimetral edge of the lateral wall. The outer flange can extend along a single prevailing development plane or can be shaped; in the case of a shaped outer flange, the latter may for example exhibit multiple portions extending along different prevailing development planes, particularly parallel but offset from each other. Preferably, the portions of the shaped outer flange can be radially offset.

The support defines a top surface on which the product P can be placed and/or a volume inside which the product can be housed.

The tray may comprise an upper edge portion emerging radially from a free edge of the lateral wall opposite the base: the upper edge portion emerges from the lateral wall in an outgoing direction relative to the tray volume.

The flat support can be of any shape, for example rectangular, rhomboidal, circular or elliptical; similarly, the tray with lateral wall can have a base of any shape, for example rectangular, rhomboidal, circular or elliptical. The support can be formed by means of a specific manufacturing process distinct from the packaging process or can be implemented in line with the packaging process.

The support can be made at least partly of paper material, optionally having at least 50% by weight, preferably at least 70% by weight, of organic material comprising one or more of cellulose, hemicellulose, lignin, lignin derivatives. The subject paper material extends between a first and a second prevailing development surface. The paper sheet material used for making the support may, in one embodiment variant, be covered by at least a part of the first and/or second prevailing development surface by means of a plastic coating, such as a food-grade film. If the coating is arranged so as to cover at least part of the first prevailing development surface, the same coating will define an inner surface of the support. Vice versa, if the coating is arranged on the second prevailing development surface, the same coating will define an outer surface of the support. The coating may also be heat-treated in such a way as to be able to act as an element for engaging and securing portions of the support as better described below. The coating may also be used to define a sort of barrier to water and/or humidity useful for preventing the weakening and loss of structurality of the support with consequent uncontrolled deformation of the paper material constituting the latter component. The coating can be applied to the paper material (as specified above on the inside and/or outside of the support) in the form of a so-called lacquer deposited from a solution or sprayed, the thickness whereof is generally comprised, but not limited to, between 0.2 and 10 μm. Alternatively, the coating may comprise a plastic film, for example a polyethylene, which can be applied by means of a rolling process, on one or both sides (inner and/or outer side) of the paper material defining the support. If the coating is applied by rolling, the values of the plastic film (coating) may for example range between 10 and 400 μm, in particular between 20 and 200 μm, even more particularly between 30 and 80 μm, of coating material (i.e. of polythene). The plastic coating material may be selected, by way of example, from the following materials: PP, PE (HDPE, LDPE, MDPE, LLDPE), EVA, polyesters (including PET and PETg), PVdC.

The support may be alternatively made at least in part of a mono-layer and multilayer thermoplastic material. Preferably, the support is provided with gas barrier properties. As used herein, this term refers to a film or sheet of material that has an oxygen transmission rate of less than 200 $cm^3/(m^2*day*bar)$, less than 150 $cm^3/(m^2*day*bar)$, less than 100 $cm^3/(m^2*day*bar)$ when measured in accordance with ASTM D-3985 at 23° C. and 0% relative humidity. Gas barrier materials suitable for single-layer thermoplastic containers are e.g. polyesters, polyamides, ethylene vinyl alcohol (EVOH), PVdC and the like.

Preferably, the support is made of a multilayer material comprising at least one gas barrier layer and at least one heat-sealable layer to allow welding of the coating film to the surface of the support.

The gas barrier polymers that can be used for the gas barrier layer are PVDC, EVOH, polyamides, polyesters and mixtures thereof. Generally, a PVDC barrier layer will contain plasticizers and/or stabilizers as known in the art.

The thickness of the gas barrier layer will preferably be set in order to provide the material of which the carrier is composed with an oxygen transmission rate at 23° C. and 0% relative humidity of less than 50, preferably less than 10 $cm^3/(m^2*day*atm)$, when measured in accordance with ASTM D-3985.

In general, the heat-sealable layer will be selected from polyolefins, such as ethylene homo- or copolymers, propylene homo- or copolymers, ethylene/vinylacetate copolymers, ionomers and homo- or co-polyesters, e.g. PETG, a glycol-modified polyethylene terephthalate.

Additional layers, such as adhesive layers, for example to make the gas barrier layer better adhere to the adjacent layers, may preferably be present in the material of which the support is made and are selected based on the specific resins used for the gas barrier layer.

In the case of a multilayer structure, part of it can be formed as a foam. For example, the multilayer material used to form the support can comprise (from the outermost layer to the innermost food contact layer) one or more structural layers, typically made of a material such as expanded polystyrene, expanded polyester or expanded polypropylene, or cardboard, or in sheet, for example, of polypropylene, polystyrene, poly(vinyl chloride), polyester; a gas barrier layer and a thermo-weldable layer.

A frangible layer that is easy to open can be positioned adjacent to the thermo-weldable layer to facilitate the opening of the final packaging. Blends of low-cohesion polymers which can be used as a frangible layer are for example those described in WO99/54398. The overall thickness of the support will be typically, but not limited to, up to 5 mm, preferably comprised between 0.04 and 3.00 mm and more preferably between 0.05 and 1.50 mm, even more preferably between 0.15 and 1.00 mm).

The support may be made entirely of paper material (optionally coating in plastic film) or it may be entirely made of plastic material. In a further embodiment, the support is at least partly made of paper material and at least partly of plastic material; in particular, the support is made internally of plastic material and externally covered at least partly in paper material.

The support can also be used to define so-called ready-meal packages; in this configuration, the supports are made so that they can be inserted in the oven for heating and/or cooking the food product placed in the package. In this embodiment (supports for ready-meal packages), the support can, for example, be made of paper material, in particular cardboard, covered with polyester or can be entirely made of a polyester resin. For example, supports suitable for ready-meal packages are made of CPET, APET or APET/CPET, foamed or non-foamed materials. The support may further comprise a hot-weldable layer of a low melting material on the film. This hot-weldable layer can be co-extruded with a PET based layer (as described in patent applications No. EP-A-1, 529,797 and WO2007/093495) or it can be deposited on the base film by solvent deposition or by extrusion coating (for example described in U.S. documents U.S. Pat. No. 2,762,720 and EP-A-1, 252,008).

In a further embodiment, the support may be made at least partly of metal material, in particular aluminum. The support can also be made at least partly of aluminum and at least partly of paper material. In general, the support can be made in at least one of the following materials: metal, plastic, paper.

Film

A film made of plastic material, in particular polymeric material, is applied to the supports (flat supports or trays), so as to create a fluid-tight package housing the product. In order to make a vacuum pack, the film applied to the support is typically a flexible multilayer material comprising at least a first outer heat-weldable layer capable of welding to the inner surface of the support, optionally a gas barrier layer and a second, heat-resistant outer layer.

For use in a skin-pack or VSP packaging process, plastic materials, especially polymers, should be easily formed as the film needs to be stretched and softened by contact with the heating plate before it is laid on the product and the support. The film must rest on the product conforming to its shape and possibly to the internal shape of the support.

The thermo-weldable outer layer can comprise any polymer capable of welding to the inner surface of the support. Suitable polymers for the thermo-weldable layer can be ethylene and ethylene copolymers, such as LDPE, ethylene/alpha-olefin copolymers, ethylene/acrylic acid copolymers, ethylene/vinyl acetate copolymers or ethylene/vinyl acetate copolymers, ionomers, co-polyesters, for example PETG. Preferred materials for the thermo-weldable layer are LDPE, ethylene/alpha-olefin copolymers, e.g. LLDPE, ionomers, ethylene/vinyl acetate copolymers and mixtures thereof.

Depending on the product to be packaged, the film may comprise a gas barrier layer. The gas barrier layer typically comprises oxygen-impermeable resins such as PVDC, EVOH, polyamides and mixtures of EVOH and polyamides. Typically, the thickness of the gas barrier layer is set to provide the film with an oxygen transmission rate of 23° C. and 0% relative humidity of less than 100 $cm^3/m^2*m^2*atm$, preferably less than 50 $cm^3/(m^2*day*atm)$, when measured in accordance with ASTM D-3985. Common polymers for the heat-resistant outer layer are, for example, ethylene homo- or copolymers, in particular HDPE, ethylene copolymers and cyclic olefins, such as ethylene/norbornene copolymers, propylene homo- or copolymers, ionomers, polyesters, polyamides. The film may further comprise other layers such as adhesive layers, filling layers and the like to provide the thickness necessary for the film and improve its mechanical properties, such as puncture resistance, abuse resistance, formability and the like. The film is obtainable by any suitable co-extrusion process, through a flat or circular extrusion head, preferably by co-extrusion or by hot blow molding.

Again for use in a skin-pack or VSP packaging process, the film is substantially non-oriented. Typically, the film, or only one or more of its layers, is crosslinked to improve, for example, the strength of the film and/or heat resistance when the film is brought into contact with the heating plate during the vacuum skin packaging process. Crosslinking can be achieved by using chemical additives or by subjecting the film layers to an energy-radiation treatment, such as high-energy electron beam treatment, to induce crosslinking between molecules of the irradiated material. Films suitable for this application preferably have a thickness in the range between 50 and 200 μm, between 70 and 150 μm.

For use in packaging processes of products under controlled atmosphere (MAP) or in a natural atmosphere (unmodified atmosphere), the film applied to the substrate (plastic film, in particular polymeric) is typically mono-layer or multilayer, having at least one heat-sealable layer, optionally capable of thermo-retracting under heat action. The applied film may further comprise at least one gas barrier layer and optionally an heat-resistant outer layer. In particular, the film can be obtained by co-extrusion and lamination processes. The film may have a symmetrical or asymmetrical structure and may be single-layer or multilayer. Multilayer films are composed of at least two layers, more frequently at least five layers, often at least seven layers. Generally, the total thickness of the film ranges from 3 to 100 microns, normally it ranges from 5 to 50 μm, often it ranges from 10 to 30 μm.

The films may possibly be crosslinked. Crosslinking can be achieved by irradiation with high energy electrons at an appropriate dosage level as known in the art. The films described above can be heat-shrinkable or heat-curable. Heat-shrinkable films normally show a free shrinking value at 120° C. (value measured in accordance with ASTM D2732, in oil) in the range from 2 to 80%, normally from 5 to 60%, in particular from 10 to 40% in both longitudinal and transverse directions. Heat-curable films normally have a shrinkage value of less than 10% at 120° C., normally less than 5% both in the transverse and longitudinal direction (measured in accordance with the ASTM D2732 method, in oil). Films normally comprise at least one heat-sealable layer and an outer layer (the outermost) generally consisting of heat-resistant polymers or polyolefins. The welding layer typically comprises a heat-sealable polyolefin which in turn comprises a single polyolefin or a mixture of two or more polyolefins such as polyethylene or polypropylene or a mixture thereof. The welding layer may also be provided with anti-fogging properties through known techniques, for example by incorporation in its composition of anti-fogging additives or through a coating or a spraying of one or more anti-fogging additives that counteract the fogging on the surface of the welding layer. The welding layer may also comprise one or more plasticizers. The outermost layer may comprise polyesters, polyamides or polyolefins. In some structures, a mixture of polyamide and polyester can be advantageously used for the outermost layer. In some cases, the films include a gas barrier layer. Barrier films normally have an oxygen transmission rate, also called OTR (Oxygen Transmission Rate) below $cm^3/(m^2*day*atm)$ and more frequently below 80 $cm^3/(m^2*day*atm)$ evaluated at 23° C. and 0% RH measured in accordance with the ASTM D-3985 method. The barrier layer is normally made of a thermoplastic resin selected from a saponified or hydrolyzed product of ethylene-vinyl acetate copolymer (EVOH), an amorphous polyamide and vinyl-vinylidene chloride and mixtures thereof. Some materials include an EVOH barrier layer, layered between two polyamide layers. In some packaging applications, films do not include any gas barrier layer. These films usually comprise one or more polyolefins as defined herein.

Non-gas barrier films normally have an OTR (evaluated at 23° C. and 0% RH in accordance with ASTM D-3985) of 100 $cm^3/(m^2*day*atm)$ up to 10000 $cm^3/(m^2*day*atm)$, more often up to 6000 $cm^3/(m^2*day*atm)$.

Peculiar compositions based on polyester are those used for the films of the so-called ready-meals. For these films, the polyester resins of the film may constitute at least 50%, 60%, 70%, 80% and 90% by weight of the film. These films are normally used in combination with supports, especially trays, made from polyester. In the case of packages for fresh red meat, a double film may be used, comprising an oxygen permeable inner film and an oxygen impermeable outer film. The combination of these two films greatly prevents discoloration of the meat even in the most critical situation in the barrier packaging of fresh meat or when the packaged meat extends outside the cavity defined by the tray, or in which the product emerges from the upper perimetral edge of the lateral wall. These films are described for example in European patent applications EP1848635 and EP0690012.

The film may be single-layer. The typical composition of the single-layer films comprises the polyesters as defined herein and mixtures thereof or the polyolefins as defined herein and mixtures thereof.

In all the film layers described herein, the polymeric components may contain suitable amounts of additives normally included in such compositions.

Some of these additives are normally included in the outer layers or in one of the outer layers, while others are normally added to the inner layers. These additives include slipping or anti-blocking agents such as talc, waxes, silica and the like, or antioxidant agents, stabilizers, plasticizers, fillers, pigments and dyes, cross-linking inhibitors, cross-linking agents, UV absorbers, odor absorbers, oxygen scavengers, antistatic agents, antifog agents or compositions and similar additives known to the man skilled in the art of packaging.

The films may have one or more holes adapted to allow the fluid communication between the inner volume of the package and the external environment, or, in the case of a food product, allow the packaged food to exchange gas with the outside; the perforation of the films can, for example, be performed by means of a laser beam or mechanical means, such as rollers provided with needles. The number of perforations applied and the size of the holes influence the permeability to the gases of the film itself.

Micro-perforated films are usually characterized by OTR values (evaluated at 23° C. and 0% RH in accordance with ASTM D-3985) of 2500 $cm^3/(m^2*day*atm)$ up to 1000000 $cm^3/(m^2*day*atm)$. Macro-perforated films are usually characterized by OTR values (evaluated at 23° C. and 0% RH in accordance with ASTM D-3985) higher than 1000000 $cm^3/(m^2*day*atm)$.

Furthermore, the films described herein can be formulated to provide strong welds with the support or tray or peelable from the tray/support. A method of measuring the strength of a weld, herein referred to as a "welding force, is described in ASTM F-88-00. Acceptable welding force values to have a peelable weld are between 100 g/25 mm and 850 g/25 mm, 150 g/25 mm to 800 g/25 mm, 200 g/25 mm to 700 g/25 mm.

Material Specifications

The term paper material means paper or cardboard; in particular, the sheet material that can be used to make the support can have a weight of between 30 and 600 $g/m^2$, in particular between 40 and 500 $g/m^2$, even more particularly between 50 and 250 $g/m^2$.

PVDC is any vinylidene chloride copolymer in which a prevalent amount of the copolymer comprises vinylidene chloride and a lower amount of the copolymer comprises one or more unsaturated monomers copolymerizable therewith, typically vinyl chloride and alkyl acrylates or methacrylates (for example methyl acrylate or methacrylate) and mixtures thereof in different proportions.

The term EVOH includes saponified or hydrolyzed ethylene-vinyl acetate copolymers and refers to ethylene/vinyl alcohol copolymers having an ethylene co-monomer content preferably composed of a percentage of from about 28 to about 48 mole %, more preferably from about 32 and about 44 mole % of ethylene and even more preferably, and a saponification degree of at least 85%, preferably at least 90%.

The term polyamides is meant to indicate homo- and co- or ter-polymers. This term specifically includes aliphatic polyamides or co-polyamides, e.g. polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partly aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are, for example, terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanodimethanol and the like. Examples of useful polyesters include poly(ethylene terephthalate) and copolyesters obtained by reaction of one or more carboxylic acids with one or more dihydroxylic alcohols.

The term copolymer means a polymer derived from two or more types of monomers and includes terpolymers. Ethylene homo-polymers include high density polyethylene (HDPE) and low density polyethylene (LDPE). Ethylene copolymers include ethylene/alphaolefine copolymers and unsaturated ethylene/ester copolymers. The ethylene/alpha-olefin copolymers generally include copolymers of ethylene and one or more co-monomers selected from alpha-olefins having between 3 and 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm$^3$. It is generally understood that the term linear low density polyethylene (LLDPE) includes that group of ethylene/alpha-olefin copolymers which fall in the density range of between about 0.915 and about 0.94 g/cm$^3$ and in particular between about 0.915 and about 0.925 g/cm$^3$. Sometimes, linear polyethylene in the density range between about 0.926 and about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers can be obtained with heterogeneous or homogeneous polymerization processes. Another useful ethylene copolymer is an unsaturated ethylene/ester copolymer, which is the ethylene copolymer and one or more unsaturated ester monomers. Useful unsaturated esters include vinyl esters of aliphatic carboxylic acids, in which esters have between 4 and 12 carbon atoms, such as vinyl acetate, and alkyl esters of acrylic or methacrylic acid, in which esters have between 4 and 12 carbon atoms. Ionomers are copolymers of an ethylene and an unsaturated mono-carboxylic acid having the carboxylic acid neutralized by a metal ion, such as zinc or, preferably, sodium. Useful propylene copolymers include propylene/ethylene copolymers, which are copolymers of propylene and ethylene having a percentage by weight content mostly of propylene and propylene/ethylene/butene ter-polymers, which are copolymers of propylene, ethylene and 1-butene.

DETAILED DESCRIPTION

Package

Reference numeral 100 indicates as a whole a package configured for containing at least one product P, for example of a food type. As can be seen for example in FIGS. 5, 8 and 11, the package 100 comprises at least one support 1 configured for receiving the product P and at least one closing film 10 sealably constrained to the support 1: the film 10 is configured for defining—in cooperation with the support 1—a housing compartment 5 for the product P and for being subsequently removed by the user during a step of opening the package 100 so as to allow the withdrawal of the product P.

The support 1 is made of sheet material and comprises at least one supporting portion 2 representing the part of the support 1 suitable for receiving the product P directly; the support 1 further comprises at least one perimetral edge 6 which completely surrounds the supporting portion 2.

The perimetral edge 6 represents the portion of the support 1 adapted to engage the film 10 for closing the package. In the accompanying figures, a support 1 having a polygonal shape, in particular rectangular, is illustrated by way of non-limiting example. However, the possibility of providing a support 1 having a square, rhomboidal, triangular, elliptical, circular, semicircular shape or a combination thereof is not excluded.

As can be seen in the accompanying figures, the support 1 further comprises a gripping portion 22 of the perimetral edge 6 extending oppositely to the supporting portion 2; in fact, the gripping portion is a perimetral portion external to the edge 6 spaced from the supporting portion 2.

In detail, the gripping portion 22 extends along a plane coplanar to a prevailing development plane of the perimetral edge 6. The gripping portion 22 defines an upper surface 22*a* facing and directly engaged with the closing film 10; the same portion 22 further defines a lower surface 22*b* parallel to and spaced from the upper surface 22*a*. The gripping portion 22 is configured for being firmly gripped by the user during a step of opening the package 100, so as to keep the latter in a stable position and facilitate the operation of opening by the user. Preferably but not limitedly, the gripping portion 22 is integrally joined to the support 1 so as to define a single solid body. In particular, the gripping portion 22 is integrally joined to the perimetral edge 6 of the support 1 and to the supporting portion 2. In fact, the gripping portion 22 defines a tab—forming part of the perimetral edge 6—through which the user can retain the package 100 at least during a step of opening the package.

As shown in FIGS. 1, 3, 5, 8, the support 1 further comprises a removable portion 21 of the perimetral edge 6 also extending oppositely to the supporting portion 2. The removable portion 21 also extends substantially along a plane parallel to an extending plane of the supporting portion 2 and is spaced from the latter. According to a preferred embodiment, the removable portion 21 extends on a plane substantially coplanar with the gripping portion 22, defining an upper surface 21*a* facing the closing film 10 and a lower surface 21*b* parallel to said upper surface 21*a* spaced therefrom by a portion equal to the thickness of the removable portion 21.

From the point of view of the material, the removable portion 21 has a mechanical stiffness greater than a mechanical stiffness of the closing film 10. In particular, the removable portion 21 has a mechanical stiffness substantially equal to a mechanical stiffness of the perimetral edge 6 of the support 1. Said mechanical stiffness of the removable portion 21 and of the closing film 10 is measured by traction and/or bending. If the removable portion 21 and the closing film 10 are made of the same material, the removable portion 21 has a thickness greater than the corresponding thickness of the closing film 10, so as to obtain said superior mechanical stiffness. Said superior mechanical rigidity of the removable portion 21 provides the user with a considerably better grip than a case in which the grip occurs directly on a portion of the closing film 10.

Moreover, the difference in mechanical stiffness between the removable portion 21 and the closing film 10 provides the user with a better tactile perception, facilitating the user in the step of locating the removable portion 21 during an opening step.

According to a preferential embodiment, the removable portion 21 is—prior to a step of opening the package—separated from the perimetral edge 6; the removable portion 21 is configured for being firmly gripped by the user to be removed from the package during a step of opening the latter. The removable portion 21 of the perimetral edge 6 is thus separated and distinct from the perimetral edge portion 6 integrally joined to the support 1. The separation of the removable portion 21 from the perimetral edge (edge portion 6 integrally joined to the supporting portion 2) defined by means of a first cut 9. According to said embodiment, the cut 9 intersects the perimetral edge 6 at two different points. FIGS. 2 and 4 show a section at the removable portion 21 of the support 1, so as to highlight the presence of the first cut 9 defining the separation.

According to a further embodiment shown in FIG. 11, the removable portion 21 is integrally joined to the perimetral edge and in particular to the supporting portion 2 by means of a weakening portion 24. The weakening portion 24 is configured for ensuring the separation of the removable portion 21 from the perimetral edge 6 integrally joined to the support 1 during a step of opening the package 100. FIG. 12 shows a section at the removable portion 21, in particular at the weakening portion 24. As shown for example in FIG. 11, the weakening portion 24 comprises at least one indicator 9*a* which connects a reduced part of a removable portion 21 with the perimetral edge 6 integrally joined to the supporting portion 2; the remaining part of the removable portion is facing the perimetral edge and divided therefrom by means of the cut 9.

As can be seen in the accompanying figures, the support 1 provides at least two embodiments (see, for example, FIGS. 1 and 3).

In the embodiment in FIG. 1, the support 1 defines a tray comprising a base 1*a* of sheet material developing flatly between an inner surface and an outer prevailing development surface whose distance delimits the thickness of the base 1*a*; the base 1*a* comprises the supporting portion 2 adapted to receive one or more products P: in particular, at least one part of the base 1*a* defines said supporting portion 2. A lateral wall 1*b* emerges from the base 1*a*, also made of a sheet material developing between an inner surface and an outer prevailing development surface whose distance delimits the thickness of the lateral wall 1*b*. The lateral wall 1*b* extends from the base 1*a* starting from an outer perimeter of the latter: the base 1*a* and the supporting portion 2 together with the lateral wall 1*b* define an inner volume intended to receive the product P. According to the first embodiment shown in FIG. 1, said inner volume of the support 1 is defined by the inner surfaces of the base 1*a* and of the lateral wall 1*b*. In particular, the lateral wall 1*b* emerges along a transversal direction with respect to the plane of the base 1*a*. In greater detail, the lateral wall 1*b* is inclined with respect to the plane of the base 1*a* to define an angle, subtended between the inner surface of the supporting portion 2 and the inner surface of the lateral wall 1*b*, between 60° and 90°, in particular between 70° and 85°. The lateral wall 1*b* extends away from the base 1*a* starting from an outer edge and following the same shape of the latter.

As can be seen in the accompanying figures, the lateral wall 1*b* defines a free edge 4 opposed to the base 1*a* and defining an opening 12 of the support 1 (upper opening of the tray). In other words, the free edge 4 represents an upper edge of the support 1 which defines the opening 12 of the same support 1 through which the product P—for example the food product—is passed to be positioned in the inner volume of the support 1 and to be covered by the closing film 10 at the time of packaging. Advantageously, the edge 4 of the lateral wall 1*b* has a shape according to the shape of the outer perimeter of the base 1*a*. In fact, the accompanying figures show an embodiment of the support 1 in which the outer edge of the base 1*a* and the free edge 4 of the lateral wall 1*b* both have a rectangular shape.

As can be seen for example in the accompanying figures, the lateral wall 1*b* comprises a plurality of angular portions 7 defined by a first and a second side of the immediately adjacent lateral wall 1*b*. In a preferred embodiment of the support 1 shown in FIG. 1, each angular portion 7 comprises a junction 8. FIG. 1 shows an embodiment of the lateral wall 1*b* in which the latter exhibits, according to a cross-section, a rectangular shape with joined edges: in this configuration, the lateral wall 1*b* comprises four junctions 8 (radiated portions).

The perimetral edge 6—in this first embodiment of the support 1—is integrally joined to the lateral wall 1*b* and emerges from the free edge 4 according to an outgoing direction with respect to the housing compartment 5. In particular, the perimetral edge 6—in the first embodiment of the support 1—emerges transversely from the lateral wall in a direction substantially parallel to a prevailing development plane of the base 1*a*: perimetral edge 6 and supporting portion lie on parallel planes. In fact, the perimetral edge 6 represents a perimetral extension of the edge 4, in which said perimetral edge 6 is located at the opening 12 of the support 1. The perimetral edge 6 extends along a profile closed around the opening 12 of the support 1 along a plane transverse to a developing surface of the lateral wall 1*b*.

In a preferred but not limiting embodiment of the invention, the supporting portion 2 and the lateral wall 1*b* are made in one piece; as better described below, the supporting portion 2 and the lateral wall 1*b* are obtained by plastic deformation of a same sheet material. Advantageously, also the perimetral edge 6 is integrally joined to the lateral wall 1*b* and thus with the supporting portion 2 of the support 1. In a preferred embodiment, base 1*a*, supporting portion 2, lateral wall 1*b* and perimetral edge 6 form a single solid body.

In this embodiment, the gripping portion 22 and the removable portion 21 of the gripping edge are therefore spaced from the base via the lateral wall: the gripping portion 22 and the removable portion 21—in this first embodiment of the support 1 (tray) —lie on a same plane spaced from a lying plane of the base, optionally of the supporting portion 2.

According to the lateral wall, also the perimetral edge 6 has a shape that conforms to the shape of the lateral wall 1*b* and of the base 1*a*; in fact in the accompanying figures, the base 1*a* and the lateral wall 1*b* have an essentially rectangular shape: the perimetral edge 6 also has a rectangular shape. Also the perimetral edge 6 has a plurality of angular portions 7 each of which comprises a junction (radiated portions). The gripping portion 22 and the removable portion are defined at at least one of the angular portions. In particular, at least one gripping portion 22 and at least one removable portion 21 define at least one same angular portion 7, optionally a same junction 8.

In detail, the gripping portion 22 and the removable portion 21 are mutually side by side. In even greater detail, the gripping portion 22 and the removable portion 21 are placed on two different adjacent sides of the perimetral edge 6 of the support 1. Optionally, the removable portion 21 and the gripping portion 22 define at least part of the angular portion 7.

In the second embodiment shown in FIG. 3, the support 1 lies entirely on a plane (flat support); in other words, the support is defined exclusively by a base 1*a* of sheet material developing flatly between an inner surface and an outer prevailing development surface, the distance of which delimits the thickness of the base 1*a*. The base 1*a* comprises a supporting portion 2 configured for receiving one or more P products. In the accompanying figures, a support 1 having a polygonal shape, in particular rectangular shape, has been illustrated, by way of non-limiting example. In particular, also the base 1*a* exhibits, in a non-limiting manner, a polygonal shape, in particular rectangular. However, the possibility of providing a support 1 having a square, rhomboidal, triangular, elliptical, circular, semicircular shape or a combination thereof is not excluded.

In this second embodiment of the support, the supporting portion 2, the perimetral edge 6, the gripping portion 22 and the removable portion 21 of said edge 6 lie on a same development plane as schematically illustrated in FIG. 3.

Also in this second embodiment, the support 1 has a plurality of angular portions 7 each of which comprises a junction (radiated portions). FIG. 3 shows a non-limiting example of an embodiment of the support having a rectangular shape; the gripping portion 22 and the removable portion 21 are defined at at least one of the angular portions 7. In particular, at least one gripping portion 22 and at least one removable portion 21 define at least one same angular portion 7, optionally a same junction 8. Also in this second embodiment of the support, the gripping portion 22 and the removable portion 21 are mutually side by side. The gripping portion 22 and the removable portion 21 are placed on two different adjacent sides of the perimetral edge 6 of the support 1. Optionally, the removable portion 21 and the gripping portion 22 define at least part of the angular portion 7.

As briefly mentioned above, the closing film 10 is engaged at least to a portion of the perimetral edge 6 to define the fluid-tight housing compartment 5 adapted to house one or more products P.

The closing film 10 may at least partly be engaged to the perimetral edge 6 and at least partly placed in close adhesion with the product P so as to form a vacuum pack of the skin type. In a variant embodiment, the closing film 10 only engages at least part of the perimetral edge 6 of the support 1 and is spaced from the base 1*b* and in particular from the product P.

Figure 9:
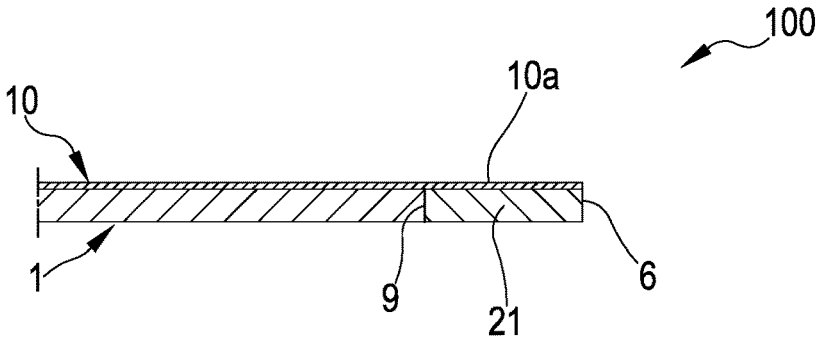
FIGS. 9 and 10 are sectional views, respectively according to lines IX-IX and XX, of the package in FIG. 8.
Figure 10:
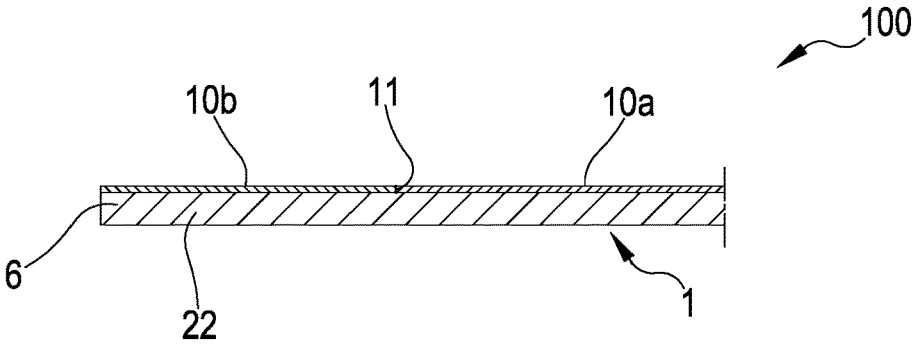
Figure 13:
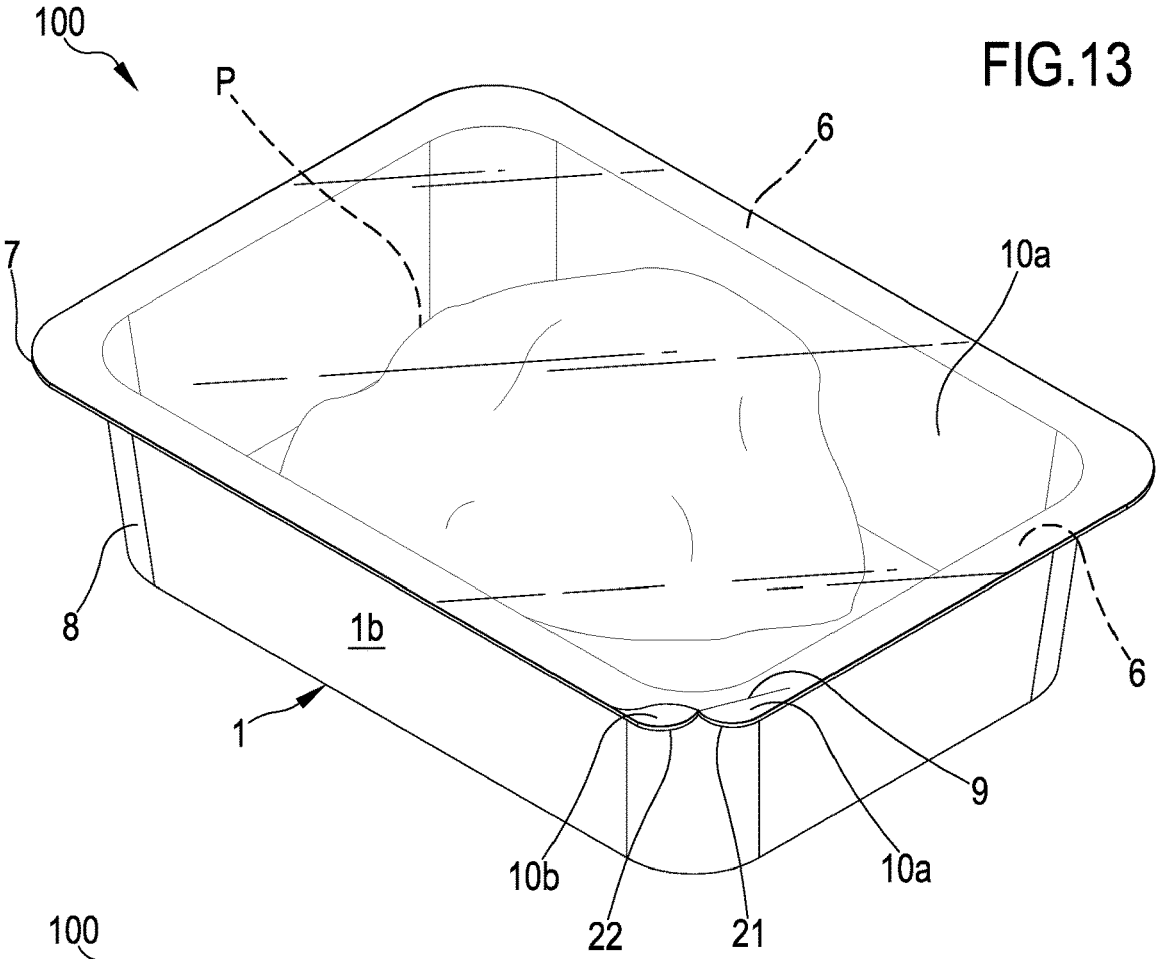
Figure 14:
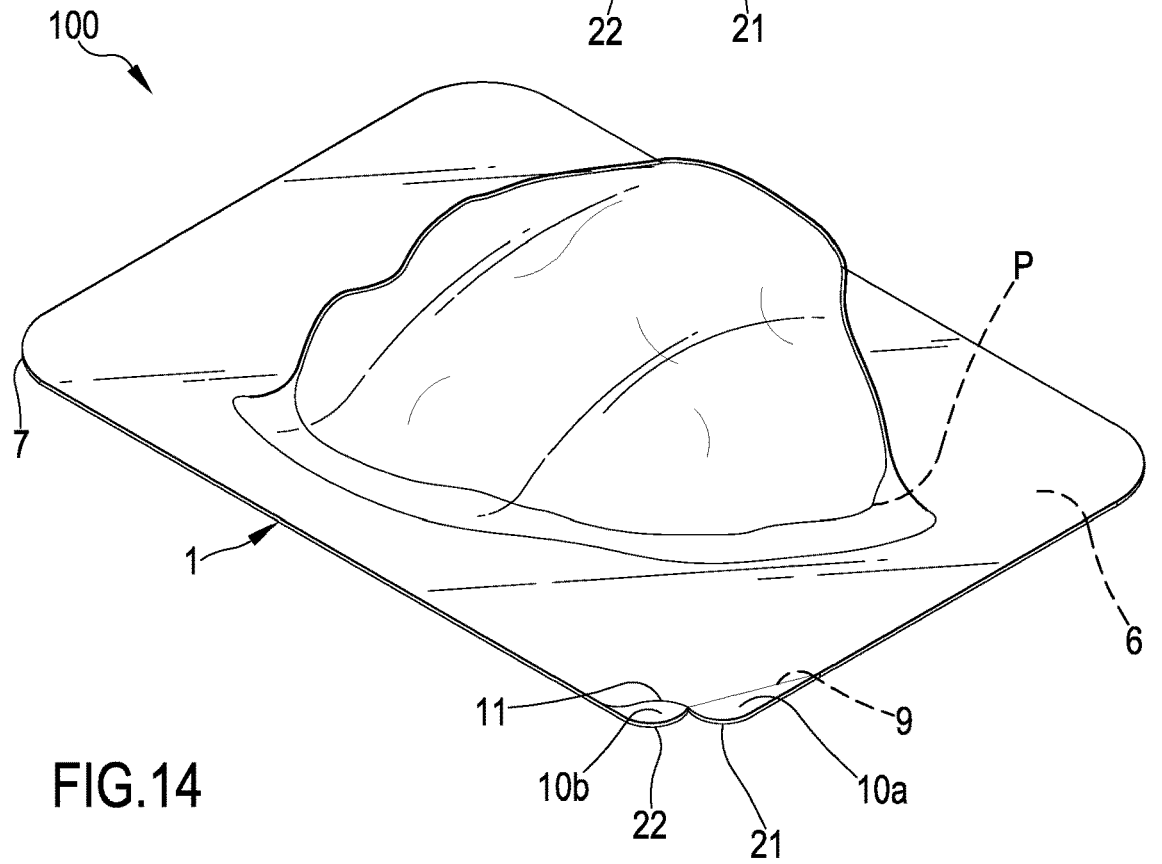
FIG. 14 is a perspective view of a package with a flat support according to the present invention.

The closing film 10 comprises a first film portion 10*a* engaged to the removable portion 21. In particular, the first film portion 10*a* is firmly adhered by a heat-welding process to the upper surface 21*a* of the removable portion 21. The removable portion 21 is thus configured for being separated at least partially from the support 1 together with the first film portion 10*a* during a step of opening the package 100. FIGS. 6 and 9 show a section at the removable portion 21 of the package 100, in which the first separation cut 9 on the support 1 is shown and the closing film 10 is applied fluid-tightly on the support 1. In greater detail, the first film portion 10*a* is firmly constrained—for example by heat-sealing—to the removable portion and to the perimetral edge 6 with the exception of the gripping portion 22. The closing film 10 in fact comprises a second film portion 10*b* only engaged with the gripping portion 22 of the support 1: the second film portion 10*b* is configured for remaining engaged with the gripping portion 22 of the support 1 during the step of opening the package 100. In particular, the second film portion 10*b* is firmly adhered to the upper surface 22*a* of the gripping portion 22 by means of a heat-sealing process. In a preferred embodiment, the second film portion 10*b* is separated from the first film portion 10*a* by a cut 11 (see, for example, FIGS. 5 and 8). In a further embodiment, the second film portion 10*b* is joined to the first portion of film 10*a* by means of a weakening portion configured for ensuring the separation of the first and second portions of the closing film during the step of opening the package. FIGS. 7 and 10 show a section at the gripping portion 22 of the package 100.

In detail, the first film portion 10*a* is engaged to at least one perimetral edge 6 and to the removable portion 21; optionally, the first film portion 10*a* is also separated from the gripping portion 22. In a same embodiment, the second film portion 10*b* is only engaged with the gripping portion 22 of the perimetral edge 6.

The perimetral edge 6 comprises an upper surface 6*a* facing the closing film 10 and extending along a plane defined by the perimetral edge 6 itself, said plane being parallel to the portion 2 of the support 1 and spaced therefrom by a portion equal to the vertical development of the lateral wall 1*b*. In particular, said upper surface 6*a* is configured for receiving the first film portion 10*a* which extends along a lying plane. The second film portion 10*b* extends along a plane parallel to the lying plane of said upper surface 6*a*, optionally the second film portion 10*b* is configured for remaining coplanar with the upper surface 6*a* of the perimetral edge during the step of opening the package 100.

Figure 15:
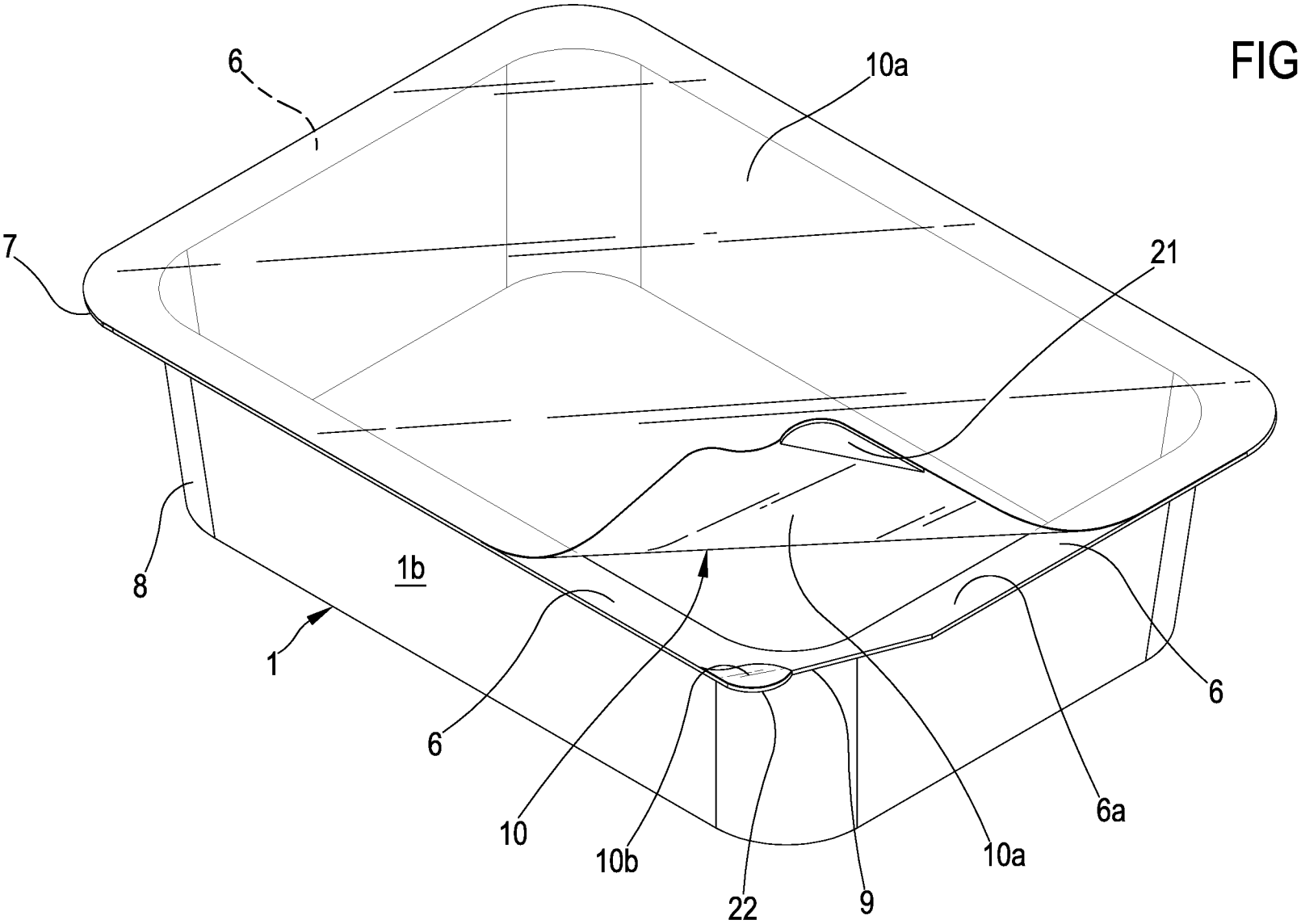
FIG. 15 is a schematic view of a package according to the present invention during an opening condition thereof.

FIG. 15 shows the step of opening the package 100 where a part of the first film portion 10*a* is raised (separated) from the perimetral edge: the removable portion 21 is engaged to said first film portion 10*a* raised and separated from the second film portion 10*b* which remains—even during the opening step—permanently constrained to the gripping portion of the support 22.

In this condition, the gripping portion together with the second film portion 10*b* define a sealing element of the package that can be used by the user for opening the package; the user can in fact grasp the gripping portion 22 and the second film portion 10*b* with one hand while with the other hand he can lift the removable portion with respect to the perimetral edge 6 to separate at least part of the first film portion 10*a* and open the package 100.

Process of Making Said Package 100

Another object of the present invention is a process for making the package 100, according to any one of the appended claims and/or according to the description given above. The process described below preferably uses the apparatus 300 described and claimed below in one or more of the accompanying claims. It should also be noted that, according to a further aspect of the invention, the various method steps described below can be carried out under the control of a control unit 311 which acts on suitable actuators and/or motors and/or pumps and/or valves in order to carry out the various steps described and on the one hand to determine the movements of the various moving parts and on the other to control the suction and/or injection of gas into a packaging chamber within which the package 100 is formed at least in part.

Figure 17:
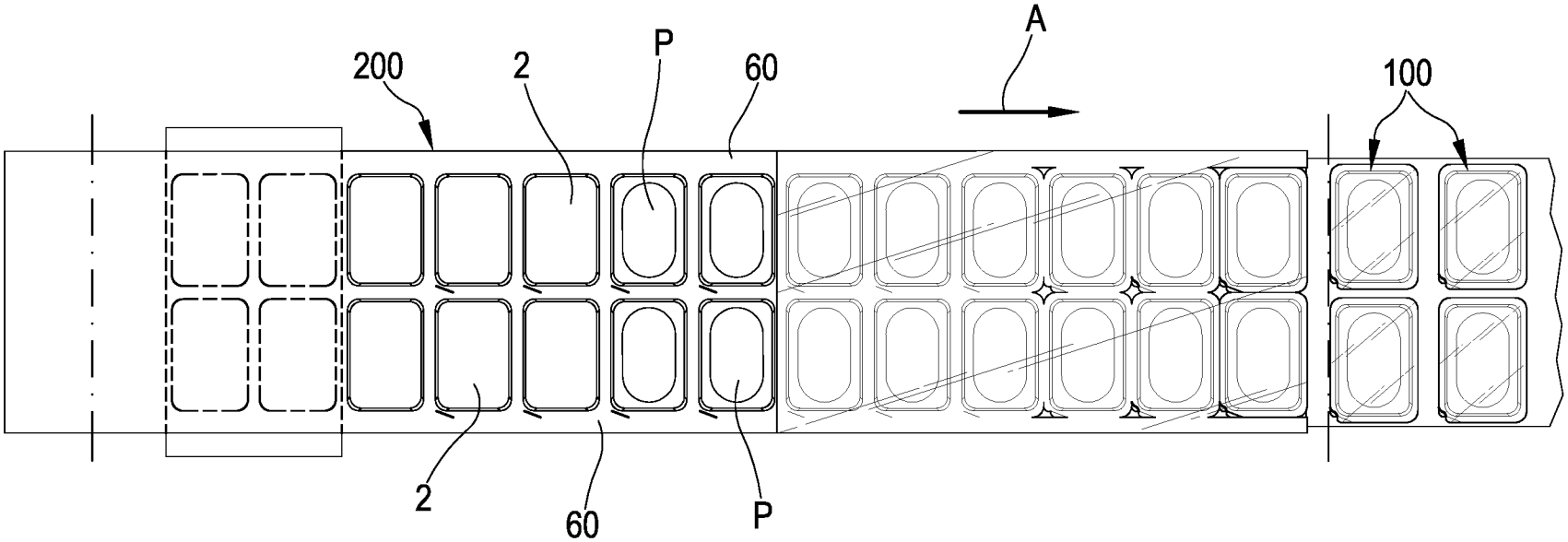
FIG. 17 is a top view schematically illustrating the configuration of the elements constituting the package according to the present invention during the process of making the latter.

The process contemplates providing a sheet material 200 along a predetermined advancement path A whose movement involves unwinding the sheet material 200 itself from a reel. The sheet material is preferentially in a tape configuration. Optionally, the manufacturing process comprises a subsequent step of forming a plurality of cavities on the sheet material 200 such that the latter defines at least a plurality of supports 1 aligned along the advancement path A of said sheet material 200. The plurality of cavities occurs by thermoforming the sheet material 200. The forming step of the cavities 200 can advantageously also define a plurality of supports 1 aligned along a transverse direction, optionally orthogonal, to the advancement path of said sheet material 200. As can be seen, for example, in FIG. 17, on the sheet material two supports 1 are defined—optionally two cavities—side by side in a direction orthogonal to the advancement path A and a plurality of supports joined together and aligned to the path A.

The sheet material 200 comprises at least one supporting portion 2 configured for receiving one or more products P, and at least one closing portion 60 which completely surrounds the supporting portion 2.

Thereafter, the process comprises a step of incising the sheet material 200 at the closing portion 60 to define on the same portion at least one cut through the edge 60.

Figure 20:
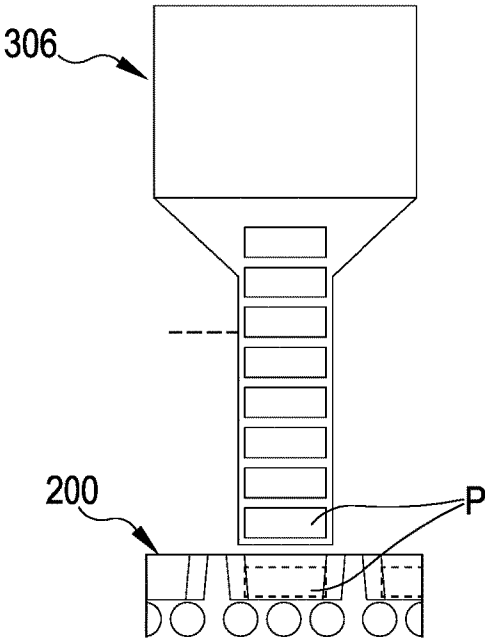
Figure 20A:
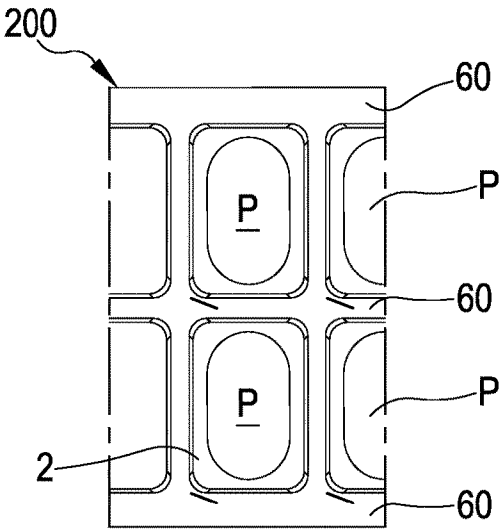

Thereafter, the process involves positioning at least one product P on the supporting portion 2 of the sheet material 200 (FIG. 20). The step of positioning the product P on the material can however be carried out before the incision of the sheet material 200 (condition not shown in the accompanying figures).

Following the positioning of the product P, the process comprises a step of constraining a closing film 201 to the closing portion 60 of the sheet material 200, so that the product P is positioned inside a housing compartment 5 defined by the closing film 201 constrained to said sheet material 200. The step of constraining the film 201 takes place by means of heat-sealing, so that the housing compartment 5 inside which said product P is housed is fluid-tight.

The process may further comprise, in a non-limiting manner, a step—after that of positioning the product P on the supporting portion 2 and before that of constraining the closing film 60—of removing at least part of the air from the housing compartment 5 in order to define inside the latter a pressure less than the atmospheric pressure to make skin-type vacuum packages. Alternatively, the process can provide for the removal of at least part of the air from the housing compartment 5 and the insertion inside the latter of a predetermined type of gas to make a modified atmosphere package.

Figure 21:
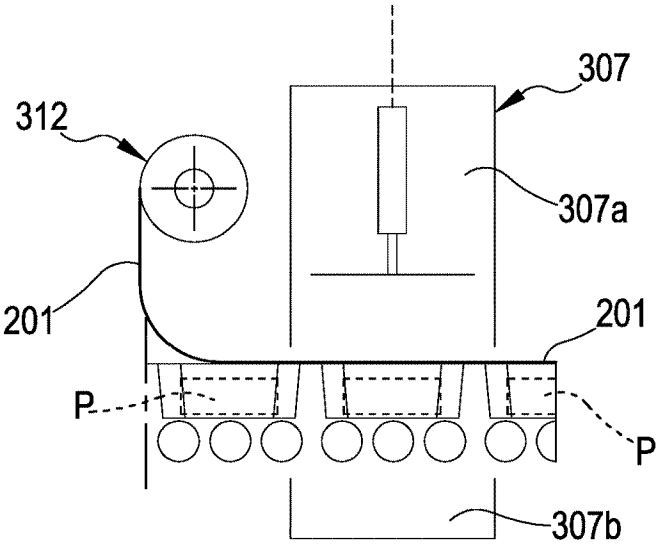
Figure 21A:
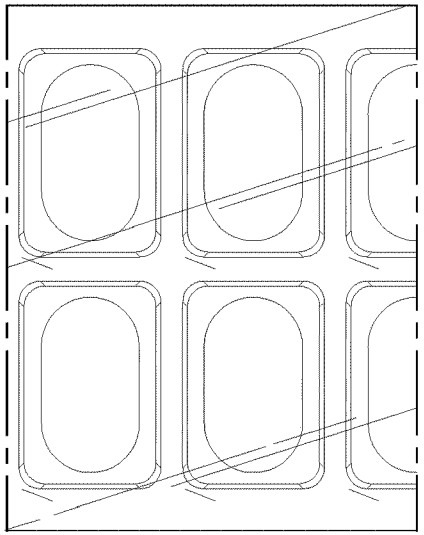

The film 201 may be unwrapped as shown in FIG. 21 and subsequently placed in a continuous film configuration above the sheet material 200 for the upper closing of the support 1. In this configuration, the closing film essentially defines a tape.

Subsequent to the step of constraining a closing film 201 to the closing portion 60 of the sheet material 200, the process involves at least the step of incising the closing film 201 engaged to the closing portion 60 of the sheet material 200; this step includes the use, in a non-limiting manner, of a high intensity concentrated laser light beam, configured for only incising said closing film 201, without modifying the sheet material 200 positioned below; for the incision of the closing film 201 only, a blade with calibrated stroke or similar tools could be used, as an alternative to the laser beam.

In particular, said incision of the closing film 201 defines a through cut of said closing film 201.

A further step of the manufacturing process, subsequent to the step of constraining a closing film 201 to the closing portion 60 of the sheet material 200, provides for the through cut of the sheet 200 and of the closing film 201 and such through cut, in cooperation with the incision of the closing portion 60 of the sheet material 200 and the incision of the closing film 201, defines the package 100.

In fact, the through cut intersects both the incision on the closing portion 60 of the sheet material 200 and the incision of the closing film 201. Only after the through-cutting step, the removable portion 21 and the gripping portion 22 of the package 100 are obtained. The through cut also defines the perimetral edge 6.

Figure 22:
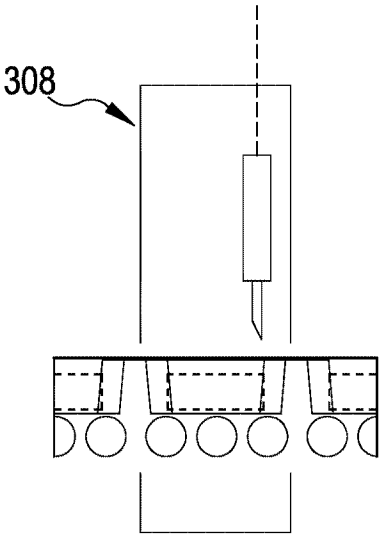
Figure 22A:
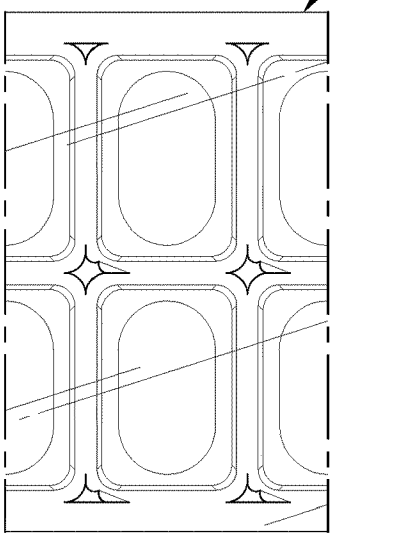

It should be noted that the through cut can be carried out in a single step following the incision of the closing film 201 or as illustrated in the accompanying figures in several steps. FIGS. 22 and 22A illustrate, for example, a part of the through-cutting step adapted to make the junction of the package on the sheet material 200 and on the film 201, and in particular the removal of corner scraps of said package. Separated from said connecting step it is possible to perform a transverse and longitudinal cutting step of the sheet material joined to said film so as to obtain separate packages.

Apparatus for Making Said Package

Another object of the present invention is an apparatus 300 for making the package 100 according to one or more of the appended claims and/or according to the description given above. In particular, the apparatus 300 is configured to perform the process claimed and/or described above used for making said package 100.

Figure 16:
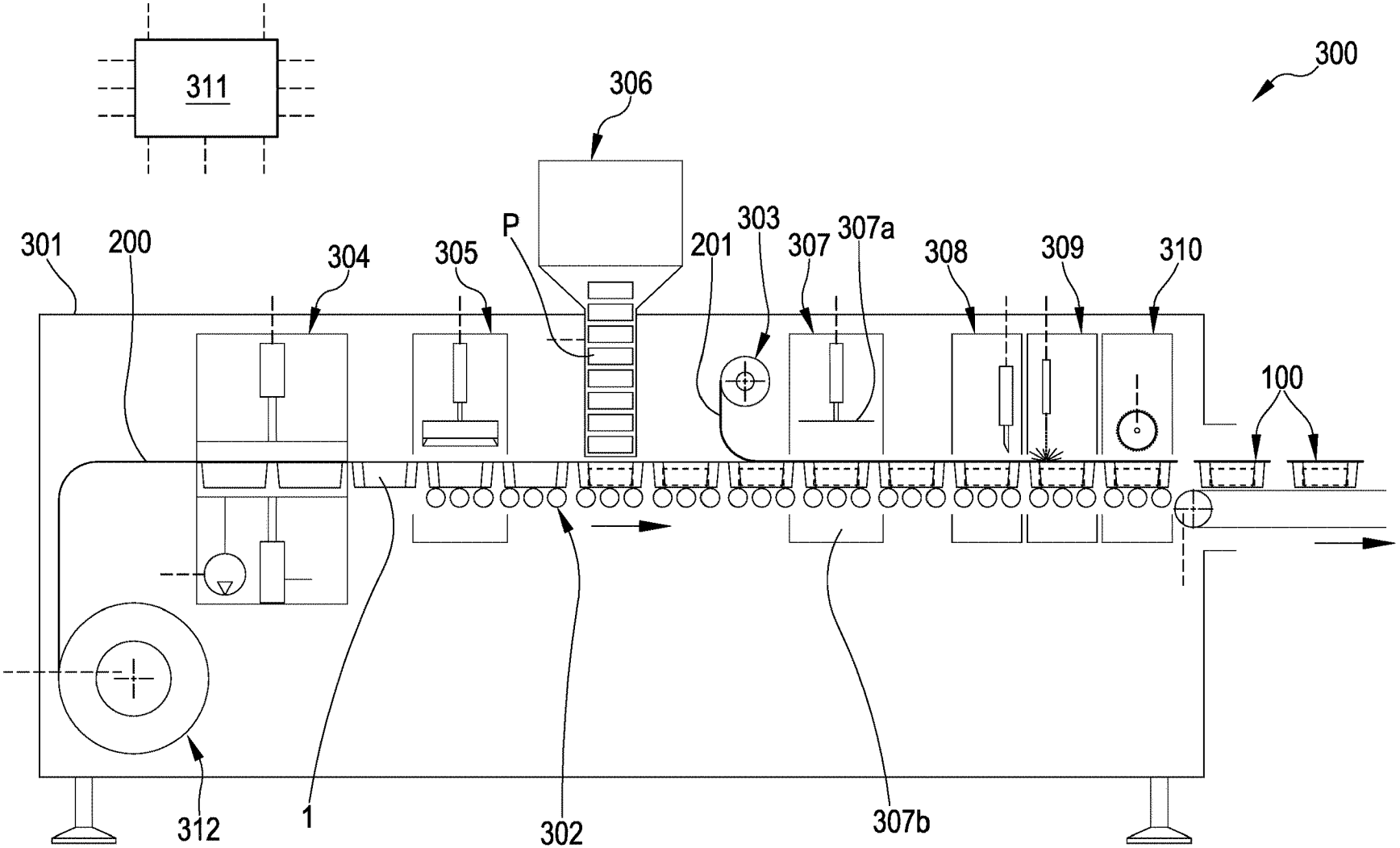
FIG. 16 is a schematic view of a packaging apparatus usable for making a package according to the present invention.

The apparatus 300, as schematically illustrated in FIG. 16, comprises a plurality of operating stations arranged sequentially to define a production line, each of said operating stations configured for performing a predetermined operation on a semi-finished product so as to obtain the package 100 at the output of the line.

The various operating stations of the apparatus 300 are described below, following an order, preferably but not in a limiting manner, of sequence of the processing steps.

The apparatus 300 comprises at least one frame 301, shown in FIG. 16, configured for supporting one or more operating stations and ensuring stability during the operating steps.

Figure 18:
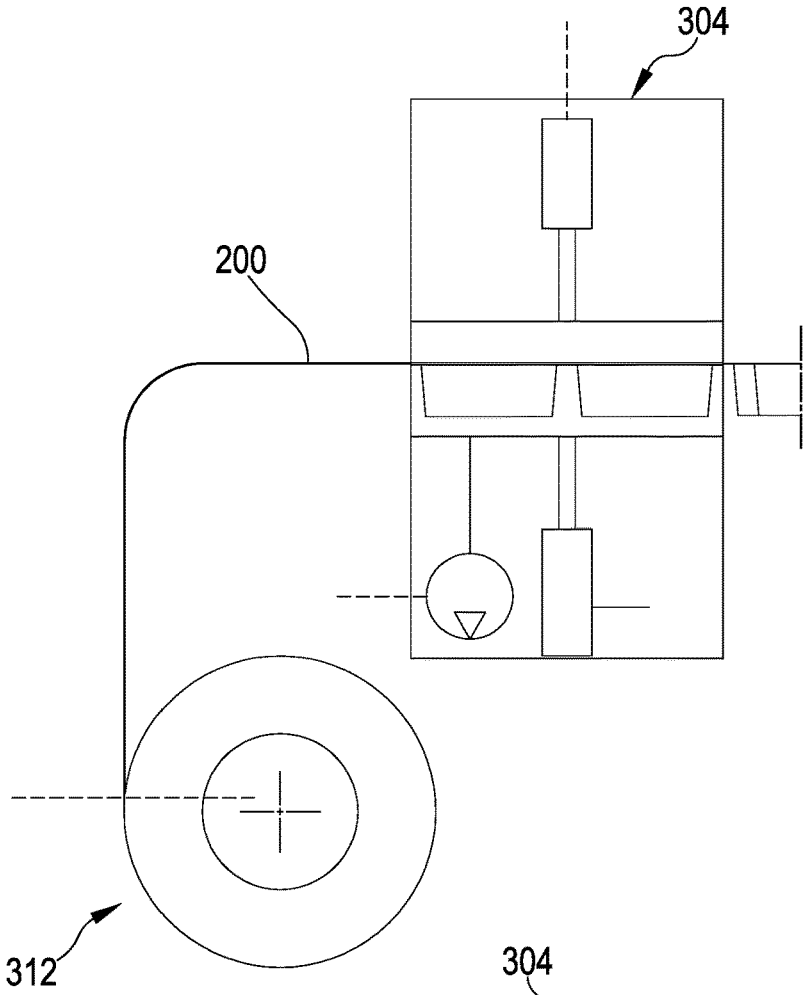
FIGS. 18 to 24A are non-limiting schematic representations of a process for making a package according to the present invention.
Figure 18A:
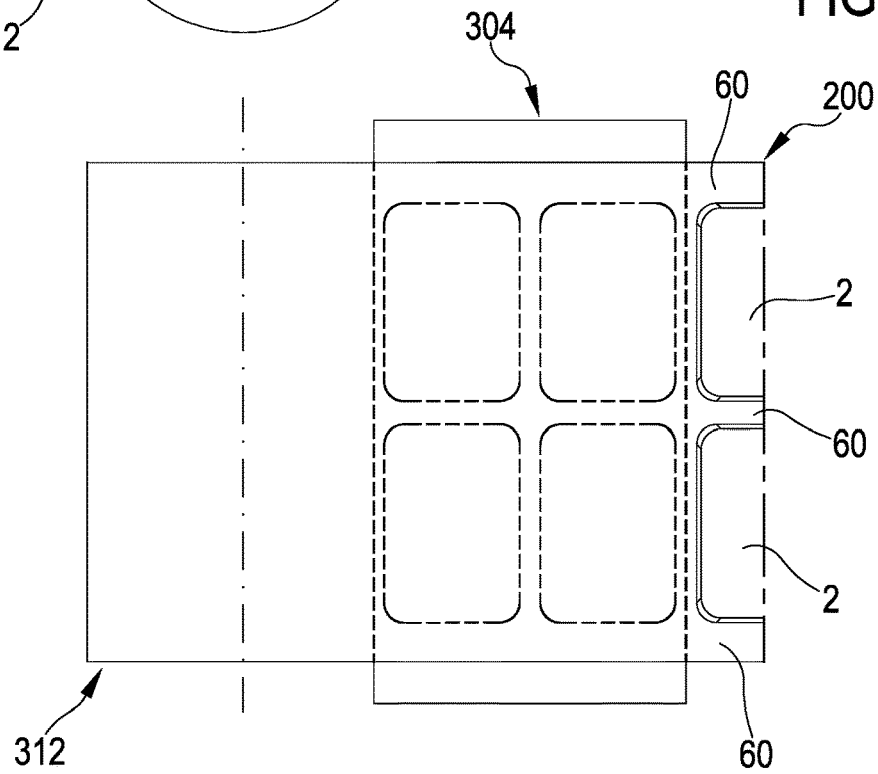

The apparatus 300 further comprises a first supplying assembly 312 shown in FIGS. 16, and 18, configured for providing the sheet material 200 and disposing it along the production line so that said sheet material 200 extends smoothly through the plurality of operating stations. The supplying assembly 312 provides the sheet material 200 wound on a reel movable by rotation, in particular said reel can be: a) moved by an electric motor, b) braked, c) free in rotation.

The movement of the sheet material 200 along a predetermined advancement path A of the sheet material 200 is ensured by the presence of a conveyor 302, shown in FIG. 16, engaged to the frame 301. Said conveyor 302 comprises a belt driven by one or more electric motors and configured for supporting the sheet material 200. In a further embodiment, said conveyor 302 comprises a system for laterally hooking the sheet material 200 by means of clamps, so as to impose its movement through the use of one or more electric motors.

Downstream of the first supplying assembly 312 of the sheet material 200, the apparatus 300 may comprise at least one thermoforming station 304, shown in FIGS. 16 and 18, configured for defining the base 1*a* and the lateral wall 1*b* of the supports 1. The thermoforming station 304 provides for heating the sheet material 200 to a predefined temperature sufficient to deform said sheet 200, imposing, by the presence of a mold, the desired shape of the support 1. In particular, the thermoforming station 304 provides for the presence of an upper tool and a lower concave mold placed inferiorly with respect to the sheet material 200, movable with respect to each other and configured for being arranged at least in a spaced condition, at which the upper tool and the lower concave mold allow the introduction of the sheet material 200 into the thermoforming station 304, and at least an approached closed condition, at which the upper tool and the lower mold define a fluid-tight chamber. During the approached closed condition, the lower concave mold provides for the suction of air in order to define a pressure lower than atmospheric pressure and consequently allow the sheet material 200, adequately heated, to adhere to the walls of said mold, obtaining the desired shape. At the outlet of said thermoforming station 304, a plurality of thermoformed supports 1 joined together is thus obtained, arranged on the sheet material 200 according to a predetermined desired shape. In case a support 1 of the flat type is used as shown in FIG. 3, the packaging apparatus 300 does not include said thermoforming station 304.

Figure 19:
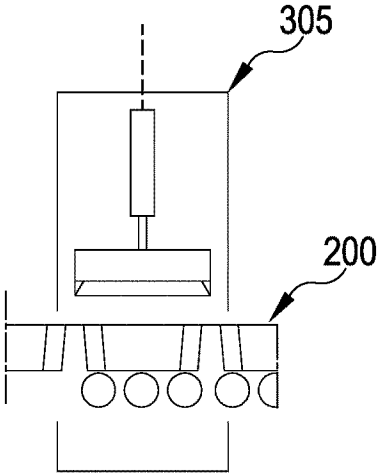
Figure 19A:
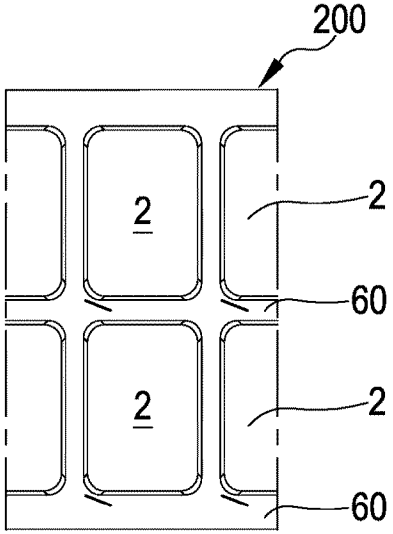

Subsequent to the thermoforming station 304 with respect to the advancement path A of the sheet material 200, the apparatus 300 comprises a first incision station 305, shown in FIGS. 16 and 19, configured for incising the thermoformed sheet material 200, in particular for making the first cut 9 of the package adapted to define at least part of the removable portion 21. Preferably but not limitedly, the cut 9 is through said sheet material 200 and made by punching. The cut 9 can also be made using a cutting tool or a high intensity concentrated beam of the laser type.

The apparatus 300 further comprises a positioning station 306, shown in FIGS. 16 and 20, configured for housing one or more products P at the supports 1, in particular at the supporting portion 2 of the base 1*a* of the support 1. The positioning station 306 is configured for delivering the product P according to the position of the supports 1 of the film material 200.

Subsequent to the positioning station 306 with respect to the advancement path A of the sheet material 200, the apparatus 300 comprises a second supplying assembly 303 shown in FIGS. 16 and 21, configured for supplying the closing film 201 and disposing it at the sheet material 200. The second supplying assembly 303 provides that the closing film 201 is wound on a reel movable by rotation, in particular said reel can be: a) moved by an electric motor, b) braked, c) free in rotation.

Downstream of the second supplying assembly 303 with respect to the advancement path A of the sheet material 200, the apparatus 300 comprises a packaging station 307, shown in FIGS. 16 and 21, configured for receiving the sheet material 200 on which one or more products P and at least a portion 201*a* of said closing film 201 are housed. Said packaging station 307 is configured for fluid-tightly engaging the closing film 201 to the sheet material 200. In order to ensure said fluid-tight engagement, the packaging station 307 comprises an upper tool 307*a* having a heater of the closing film 201, or closing film portion 201*a*, and a lower tool 307*b* configured for receiving the sheet material 200 optionally having one or more supports 1. The upper tool 307*a* having the heater of the closing film 201 is configured for making a heat-sealing of the closing film 201 on the sheet material 200, so as to define the housing compartment 5 for the product P.

The upper and lower tool 307*a*, 307*b* are movable relative to one another between at least one spaced condition, at which the lower tool and the upper tool 307*a*, 307*b* allow the input in the packaging station 307 of the closing film 201—or closing film portion 201*a*—and of the sheet material 200, and at least one approached closed condition, at which the lower and upper tool 307*a*, 307*b* define a fluid-tight chamber.

The packaging station 307 can be provided in a non-limiting manner with a suction system configured for removing air from the inside of the packaging station 307 itself so as to define a pressure lower than atmospheric pressure. In a further embodiment, the packaging station 307 is configured for removing air from the housing compartment 5 when the closing film 201 is fluid-tightly engaged to the sheet material 200. Optionally, the packaging station 307 can be provided, in a non-limiting manner, with a blowing system configured for injecting gas into the packaging station 307 in order to obtain a modified atmosphere environment. The packaging station 307 optionally includes a heater of the closing film 201 so as to facilitate the correct distribution of the closing film 201 around the product P.

FIG. 21 schematically shows the plurality of supports 1 coming out of the packaging station 307, comprising the thermoformed sheet material 200, one or more products P, the first cut 9 and the closing film 201 fluid-tightly engaged to the sheet material 200.

Downstream of the packaging station 307 with respect to the advancement path A of the sheet material 200, the apparatus 300 optionally comprises a pre-cutting station 308, shown in FIGS. 16 and 22, configured for making a plurality of cuts through the sheet material 200 and the closing film 201, so as to define at least part of the removable portion 21 and at least part of the gripping portion 22, as well as the angular portions 7 of the supports 1. According to a preferential embodiment, said through cuts are made by using a punch having a cutting portion having a predetermined shape. Alternatively, said through cuts are made by means of a cutting tool, a rotating blade or a high intensity concentrated beam of the laser type.

Figure 23:
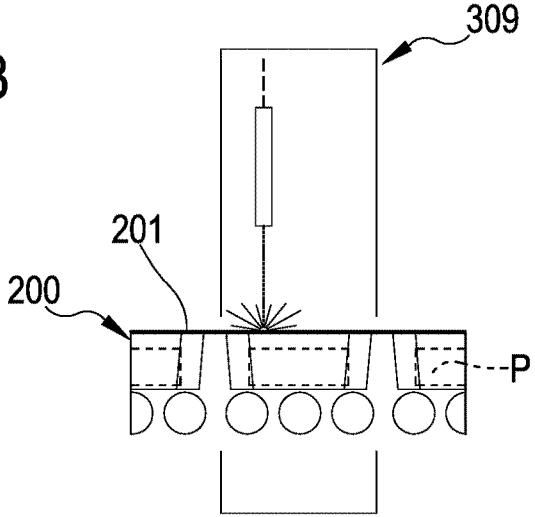
Figure 23A:
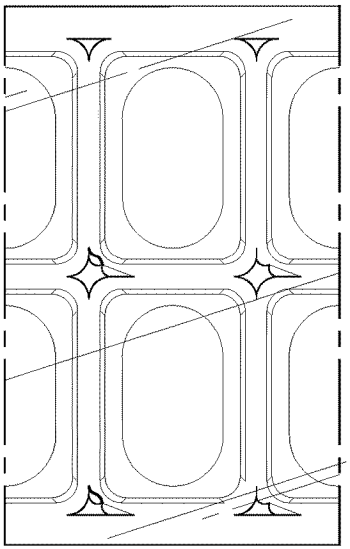
Figure 25:
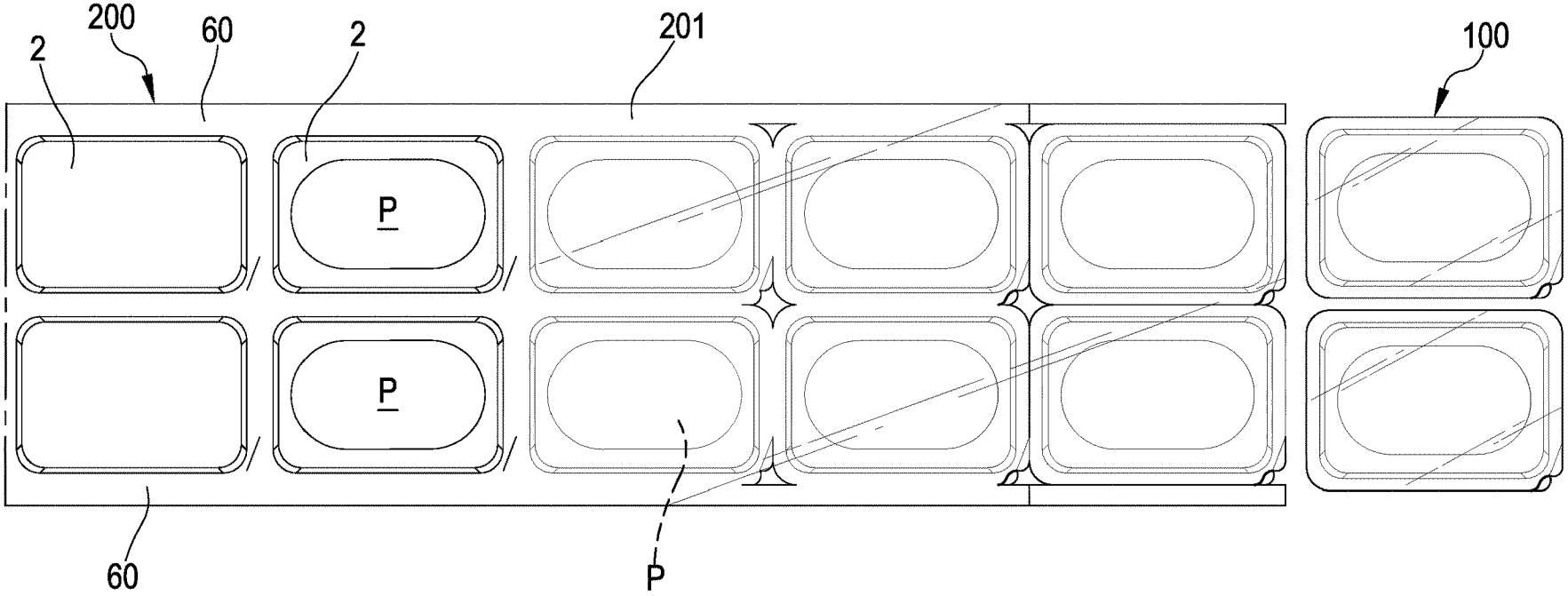
FIG. 25 is a schematic top view of the components making up the package according to the present invention during the process steps for making said package.

Downstream of the packaging station 307 and optionally downstream of the pre-cutting station 308 with respect to the advancement path A of the sheet material 200, the apparatus 300 comprises a second incision station 309, shown in FIGS. 16 and 23, configured for incising the closing film 201, or closing film portion 201*a*, engaged on the sheet material 200. In particular, the incision station 309 is configured for making an incision along the closing film 201 such that the film portion 10*b* remains engaged to the gripping portion 22 of the support 1 during a step of opening the package 100. According to a preferential embodiment, the incision defines a separation between the first and the second film portions 10*a*, 10*b*. Alternatively, the incision defines a weakened portion of the closing film 10. At the incision station 309, the incision is made only on the closing film 10 without modifying the support 1 placed below; this incision identifies in particular the cut 11 introduced above in relation to the description of the package 100. According to a preferential embodiment, said incision is made by using a high intensity concentrated laser light beam. Alternatively, said incision can be made by a cutting tool or a rotating blade.

Figure 24:
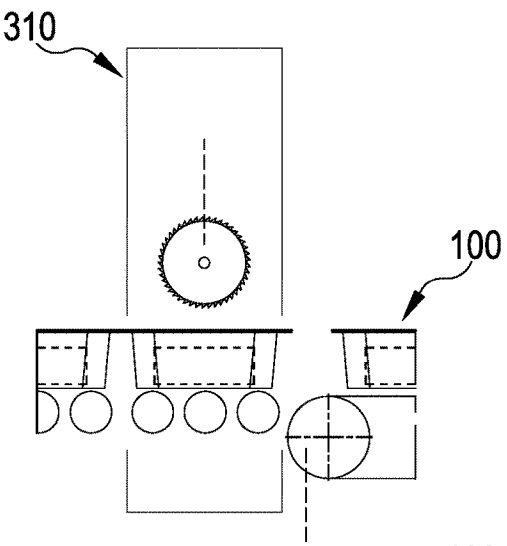
Figure 24A:
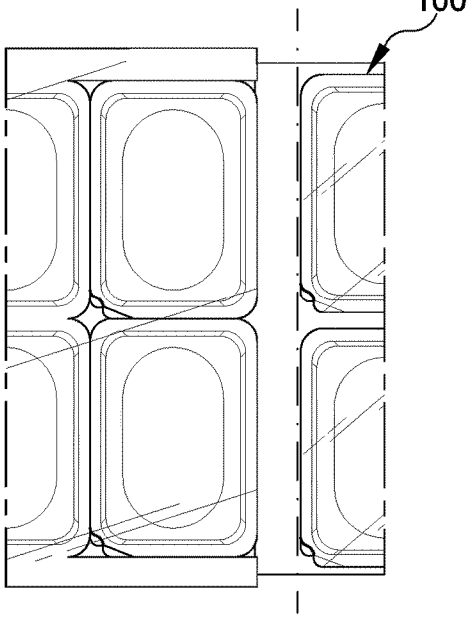

Downstream of the second cutting station 309 with respect to the advancement path A of the sheet material 200, the apparatus 300 comprises at least one cutting station 310, shown in FIGS. 16 and 24, configured for defining a through cut of the sheet material 200 and closing film 201 for forming said packages 100. In particular, according to a preferential embodiment, said through cuts are made at the edges of the supports 1, so as to define the perimetral edge 6, using one or more rotating blades. In a further embodiment, said cutting station 310 can replace the pre-cutting station 308 providing the same through cutting operations to define the removable portion 21, the gripping portion 22, as well as the plurality of angular portions 7. In a further embodiment, the cutting operations carried out at the cutting station 310 are performed by means of a punching machine or by using a high intensity concentrated laser light beam.

The packaging apparatus 300 advantageously comprises at least one control unit 311 connected to the conveyor 302, to the second supplying assembly 303, to the packaging station 307, to the first incision station 305, to the second incision station 309 and to the cutting station 310. The control unit 311 is optionally connected to the positioning station 306, to the first incision station 305, to the pre-cutting station 308 and/or to the cutting station 310. Optionally, said control unit 311 is also connected to the first supplying assembly 312.

The control unit 311 is configured for commanding the conveyor 302 to allow movement of the sheet material 200 along the operating path at a predetermined speed, for commanding the supplying assembly 303 adapted to supply the closing film 201, to commanding the first cutting station 305 to define one or more incisions on the sheet material 200, for commanding the packaging station 307 so as to allow engagement of the closing film 201—or closing film portion 201*a*—on the sheet material 200, for commanding the second incision station 309 for defining one or more incisions on the closing film, for commanding the cutting station 310 for the formation of the packages 100.

The control unit 311 is further configured for synchronizing the operations of the first and second incision station 305, 309 as a function of at least a predetermined movement speed of the sheet material 200 imparted by the conveyor 302 along the advancement path A, and/or a predetermined supplying rate of the closing film 201.

The control unit 311 is therefore configured for synchronizing the performance of the operations carried out by the single operating stations described above and arranged along the production line. Optionally, the control unit 311 is configured for receiving an input signal representative of the correct positioning of the sheet material 200 and/or of the closing film 201 at one or more of said operating stations.

The control unit 311 is further configured for synchronizing the operations of the first and second incision station 305, 309 as a function of at least one parameter representing the relative position between the lower tool and the upper tool 307*a*, 307*b* of the packaging station 307, and/or of a parameter representative of an active condition of the upper tool 307*a* in which the same heats the film portion 201*a* in engagement on the same tool.

The invention claimed is:

1. A package for containing at least one product, said package comprising:

a support exhibiting:

a supporting portion configured to receive one or more products, a perimetral edge entirely surrounding the supporting portion, a gripping portion of the perimetral edge, extending oppositely to the supporting portion;

a removable portion of the perimetral edge, also extending oppositely to the supporting portion;

a closing film engaged at least with a portion of the perimetral edge and configured to define—cooperatively with the support—a compartment to house the product, said closing film comprising:

a first film portion engaged with the removable portion, said removable portion being configured to be separated at least partially from the support along with the first film portion while the package is opened, a second film portion engaged with the gripping portion of the support, said second film portion being configured to remain engaged with the gripping portion of the support the package is opened, wherein the second film portion is:

separated from the first portion of the closing film, or joined to said first portion by a weakening portion of the same closing film, said weakening portion being configured to ensure the separation of the first and second portion of the closing film while the package is opened.

2. The package of claim 1, wherein the second film portion is:

separated from the first portion of the closing film, or joined to said first portion by the weakening portion of the closing film itself prior to the package being opened.

3. The package of claim 1, wherein the first film portion is engaged with the perimetral edge with the exception of the gripping portion.

4. The package of claim 1, wherein the second film portion is only engaged with the gripping portion of the perimetral edge.

5. The package of claim 1, wherein, before the package is opened, the removable portion is:

separated from the perimetral edge integrally joined to the support; or integrally joined to the perimetral edge of the support by a weakening portion of the support, said weakening portion being configured to ensure the separation of the removable portion from the support while the package is opened.

6. The package of claim 1, wherein the gripping portion is integrally joined to the perimetral edge.

7. The package of claim 1, wherein the perimetral edge comprises an upper surface to receive the first film portion, which extends along a lying plane, wherein the second film portion extends along a plane parallel to the lying plane of said upper surface.

8. The package of claim 1, wherein the support comprises:

a base, a lateral wall transversally emerging from the base to define a housing seat adapted to receive the product, wherein the perimetral edge along with the gripping portion are integrally joined to the lateral wall oppositely to the base, wherein the perimetral edge defines an upper free edge of the support delimiting an opening of the latter.

9. The package of claim 1, wherein the support comprises at least one angular portion, said removable portion defines at least part of said angular portion, the gripping portion flanking the removable portion to define cooperatively with the latter at least part of the angular portion.

10. The package of claim 1, comprising at least one product disposed in the housing compartment of the package, the closing film being fluid-tightly engaged with the perimetral edge of the support so that the housing compartment inside which said product is housed, is fluid-tight.

11. A process of making a package, wherein:
the package comprises:
a support exhibiting:
a supporting portion configured to receive one or more products,
a perimetral edge entirely surrounding the supporting portion,
a gripping portion of the perimetral edge, extending oppositely to the supporting portion;
a removable portion of the perimetral edge, also extending oppositely to the supporting portion;
a closing film engaged at least with a portion of the perimetral edge and configured to define—cooperatively with the support—a compartment to house the product, said closing film comprising:
a first film portion engaged with the removable portion, said removable portion being configured to be separated at least partially from the support along with the first film portion while the package is opened,
a second film portion engaged with the gripping portion of the support, said second film portion being configured to remain engaged with the gripping portion of the support the package is opened,
wherein the second film portion is:
separated from the first portion of the closing film, or
joined to said first portion by a weakening portion of the same closing film, said weakening portion being configured to ensure the separation of the first and second portion of the closing film while the package is opened; and
said process comprises:
moving a sheet material along a predetermined advancement path, said sheet material comprising:
a supporting portion configured to receive one or more products,
a closing portion entirely surrounding the supporting portion,
performing at least one incision on the closing portion of the sheet material adapted to define said removable portion,
positioning at least one product on the supporting portion of said sheet material,
following positioning the product on the sheet material, constraining a closing film to the closing portion of the sheet material so that the product is positioned inside a housing compartment defined by the closing film constrained to said sheet material,
performing at least one incision of the closing film engaged with the closing portion of the sheet material to define the first and second film portions respectively engaged with the removable portion and the gripping portion of the support.

12. The process of claim 11, further comprising:
making at least one through cut of the sheet and closing film, such through cut—cooperatively with the incision of the closing portion of the sheet material and the incision of the closing film—defines said package—in at least one point—one selected between:
the incision of the closing portion of the sheet material, and
the incision of the closing film.

13. The process of claim 11, wherein the incising of the closing film is after the constraining of said closing film to the closing portion of the sheet material.

14. The process of claim 12, wherein the through cut of the sheet and closing film defines the removable portion and gripping portion of the package.

15. The process of claim 11, wherein the constraining of the closing film on the closing portion of the sheet material is performed by heat-seal.

16. The process of claim 11, comprising at least one of:
after positioning the product on the supporting portion and before constraining the closing film, removing at least part of the air from the housing compartment in order to define inside the latter a pressure less than the atmospheric pressure; and
after positioning the product on the supporting portion and before constraining the closing film, removing at least part of the air from the housing compartment and inserting inside the latter a predetermined type of gas to define a modified-atmosphere package.

17. The process of claim 11, further comprising forming a plurality of cavities on the sheet material so that the latter defines a plurality of trays aligned along the advancement path, wherein the forming of the cavities is performed before positioning the product on the sheet material, wherein the forming of the cavities enables definition of at least a plurality of trays aligned along a direction transversal to the advancement path of said sheet material.

18. An apparatus for making a package wherein:
a package comprising: a support exhibiting: a supporting portion configured to receive one or more products, a perimetral edge entirely surrounding the supporting portion, a gripping portion of the perimetral edge, extending oppositely to the supporting portion; a removable portion of the perimetral edge, also extending oppositely to the supporting portion; a closing film engaged at least with a portion of the perimetral edge and configured to define cooperatively with the support a compartment to house the product, said closing film comprising: a first film portion engaged with the removable portion, said removable portion being configured to be separated at least partially from the support along with the first film portion while the package is opened, a second film portion engaged with the gripping portion of the support, said second film portion being configured to remain engaged with the gripping portion of the support the package is opened, wherein the second film portion is: separated from the first portion of the closing film, joined to said first portion by a weakening portion of the same closing film, said weakening portion being configured to ensure the separation of the first and second portion of the closing film while the package is opened; wherein the apparatus being configured for, moving a sheet material along a predetermined advancement path, said sheet material comprising a supporting portion configured to receive one or more products, a closing portion entirely surrounding the supporting portion, performing at least one incision on the closing portion of the sheet material adapted to define said removable portion, positioning at least one product on the supporting portion of said sheet material, following positioning the product on the sheet material, constraining a closing film to the closing portion of the sheet material so that the product is positioned inside a housing compartment defined by the closing film constrained to said sheet material, performing at least one incision of the closing film engaged with the closing portion of the sheet material to define the first and second film portions respectively engaged with the removable portion and the gripping portion of the support;

a conveyor configured to move the sheet material along a predetermined advancement path, a second supplying assembly configured to deliver the closing film, a packaging station configured to receive the sheet material on which one or more products and at least one portion of said closing film are housed, said packaging station being configured to fluid tightly engage the closing film to the sheet material, at least one first incision station placed upstream of the packaging station with respect to the advancement path of the sheet material and which is configured to incise the latter, at least one second incision station placed downstream of the packaging station with respect to the advancement path of the sheet material and which is configured to incise at least a portion of the closing film engaged on the sheet material.

19. The apparatus of claim 18, further comprising at least one cutting station placed downstream of the second incision station and configured to define a through cut of the sheet material and closing film to form said packages.

* * * * *